US008733874B2

(12) United States Patent
Baba

(10) Patent No.: US 8,733,874 B2
(45) Date of Patent: May 27, 2014

(54) PRINTING APPARATUS AND IMAGE PROCESSING METHOD

(75) Inventor: Naoko Baba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 295 days.

(21) Appl. No.: 12/815,665

(22) Filed: Jun. 15, 2010

(65) Prior Publication Data

US 2010/0321434 A1 Dec. 23, 2010

(30) Foreign Application Priority Data

Jun. 23, 2009 (JP) ..... 2009-148828

(51) Int. Cl.
*B41J 29/38* (2006.01)

(52) U.S. Cl.
USPC ..... 347/12; 347/19

(58) Field of Classification Search
USPC ..... 347/13, 12, 14, 19
See application file for complete search history.

(56) References Cited

U.S. PATENT DOCUMENTS 7,347,519 B2 3/2008 Nagamura et al.
2006/0284910 A1 * 12/2006 Aruga ..... 347/19
2007/0285457 A1 12/2007 Nagamura et al.
2009/0021543 A1 1/2009 Baba
2009/0040256 A1 2/2009 Baba et al.

FOREIGN PATENT DOCUMENTS

JP 2004-167947 A 6/2004

* cited by examiner

*Primary Examiner* — Julian Huffman
(74) *Attorney, Agent, or Firm* — Fitzpatrick, Cella, Harper & Scinto

(57) ABSTRACT

It is possible to implement a calibration process that corrects density unevenness even in the case where the utilization ratios of the plurality of nozzle arrays used in printing differ. Concretely, making use of a print head provided with a plurality of nozzle arrays ejecting ink of the same color, it is a printing apparatus that performs printing, based on print data, by ejecting ink from the nozzles provided in the nozzle arrays, and has a print density characteristic acquisition unit, which acquires the print density characteristics of each of the nozzle arrays, and a nozzle array contribution ratio establishing unit, which establishes the printing ratios of the nozzle arrays that print a predetermined printing area, and does color shift correction processing of the print data based on each of the print density characteristics of the nozzle arrays and the nozzle array contribution ratios.

11 Claims, 24 Drawing Sheets

| 5a-406-1 | 5a-407-1 |
|---|---|
| 100% | 0% |
| 100% | 0% |
| 100% | 0% |
| 100% | 0% |
| 100% | 0% |
| 100% | 0% |
| 50% | 50% |
| 50% | 50% |
| 50% | 50% |
| 50% | 50% |
| 0% | 100% |
| 0% | 100% |
| 0% | 100% |
| 0% | 100% |
| 0% | 100% |
| 0% | 100% |
| 100% | 0% |
| 100% | 0% |
| 100% | 0% |
| 100% | 0% |
| 100% | 0% |
| 100% | 0% |
| 50% | 50% |
| 50% | 50% |
| 50% | 50% |
| 50% | 50% |
| 0% | 100% |
| 0% | 100% |
| 0% | 100% |
| 0% | 100% |
| 0% | 100% |
| 0% | 100% |
| 100% | 0% |
| 100% | 0% |
| 100% | 0% |
| 100% | 0% |
| 100% | 0% |
| 100% | 0% |
| 50% | 50% |
| 50% | 50% |
| 50% | 50% |
| 50% | 50% |
| 0% | 100% |
| 0% | 100% |

FIG.10B

| 5a-406-2 | 5a-407-2 |
|---|---|
| 100% | 0% |
| 100% | 0% |
| 100% | 0% |
| 100% | 0% |
| 100% | 0% |
| 100% | 0% |
| 50% | 50% |
| 50% | 50% |
| 75% | 25% |
| 50% | 50% |
| 50% | 50% |
| 50% | 50% |
| 50% | 50% |
| 50% | 50% |
| 25% | 75% |
| 25% | 75% |
| 75% | 25% |
| 75% | 25% |
| 50% | 50% |
| 50% | 50% |
| 50% | 50% |
| 50% | 50% |
| 25% | 75% |
| 25% | 75% |
| 75% | 25% |
| 75% | 25% |
| 50% | 50% |
| 50% | 50% |
| 50% | 50% |
| 50% | 50% |
| 25% | 75% |
| 25% | 75% |
| 75% | 25% |
| 75% | 25% |
| 50% | 50% |
| 50% | 50% |
| 50% | 50% |
| 50% | 50% |
| 25% | 75% |
| 25% | 75% |
| 75% | 25% |
| 75% | 25% |
| 50% | 50% |
| 50% | 50% |

FIG.12C

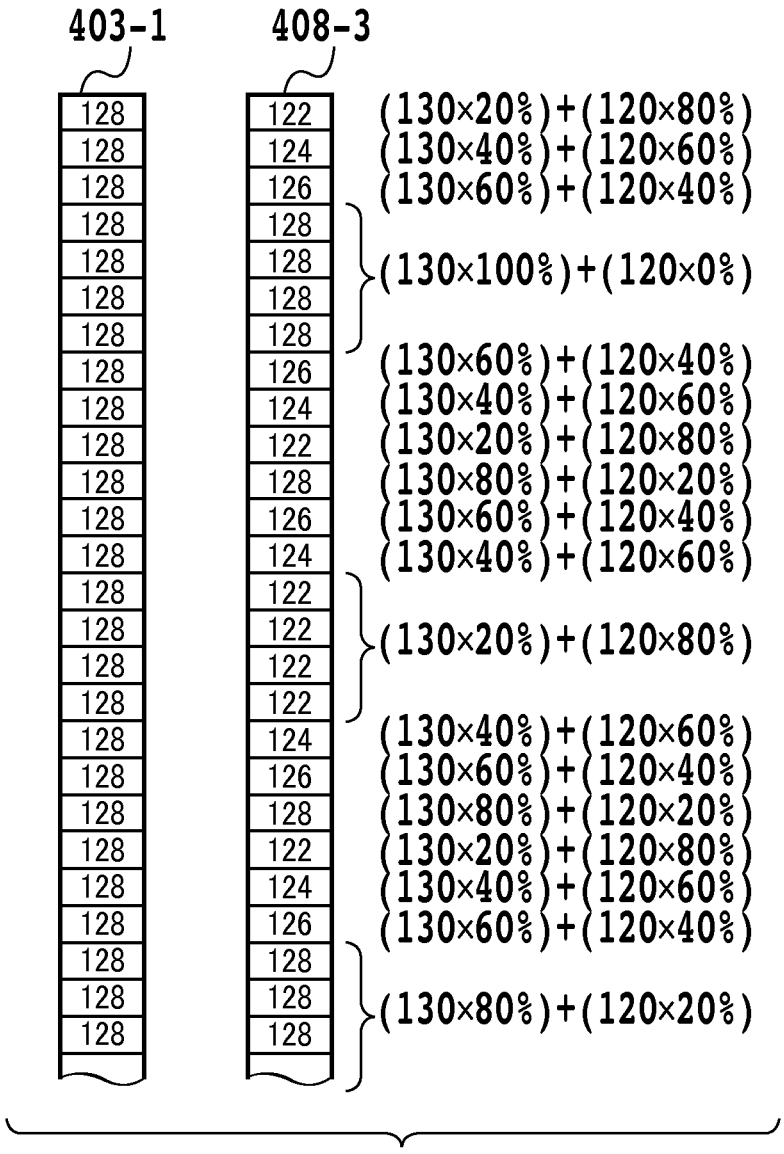
403-1
408-3
128
128
128

PRINTING APPARATUS AND IMAGE PROCESSING METHOD

BACKGROUND OF THE INVENTION

1. Field of the Invention

The present invention relates to a printing apparatus and image processing method, and particularly to a printing apparatus and image processing method that correct density unevenness.

2. Description of the Related Art

Ink jet printing apparatuses that are provided with a plurality of print heads or a plurality of nozzle arrays for ejecting ink of the same color are known. By providing a plurality of print heads or a plurality of nozzle arrays it is possible to achieve improved printing speeds. Printing apparatuses such as these, which are provided with a plurality of print heads or a plurality of nozzle arrays, however, often produce density or color unevenness in printed images. One cause of this is that an ejection characteristic difference between each print head or each nozzle array nozzle exists or is produced. Variation in the amount of heat generated by the heat generating heater, which is for ejecting ink, and variation in nozzle opening (ejection opening) diameter are raised as main causes of this kind of ejection characteristic difference between each print head or each nozzle array. There are also times when ejection characteristic differences are produced by fluctuations in the amount of heat generated by the heat generating heater, due to aging, or ink viscosity fluctuations, due to a change in the usage environment.

Calibration techniques are known as techniques to control density unevenness and the like caused by these kinds of ejection characteristic differences. These calibrations, for example, are carried out by changing the tables used in the y correction process that is performed as part of the image processing for correction of the ejection characteristics of the print head. Concretely, it is carried out by printing a patch on the print medium, detecting, from the resultant printed patch, the ejection characteristics of each print head or nozzle array at that time, and resetting the table used in the y correction process to a suitable object. As methods for detecting ejection characteristics based on a printed patch, there are methods of detection (inspection) of the printed patch by eyesight and methods of detection making use of input devices such as scanners and the like.

For example, in Laid Open Japanese Patent No. 2009-167947, a method of automatically carrying out correction (calibration) of density or color unevenness based on the result measured from establishing, in the carriage of the printing apparatus, a scanner or a light sensor for reading patches, and performing a density measurement of the printed patch via this scanner or the like. In this method, respective calibrations are carried out with respect to print heads of each ink color, and density correction values are obtained for each gradation of each ink color. Many of the previously known calibrations, as described in the above Laid Open Japanese Patent No. 2009-167947, are carried out in this manner with respect to respective print heads of each color of ink.

In contrast, as in the aforementioned printing apparatuses that are configured to be provided with a plurality of print heads, or a plurality of nozzle arrays of the same ink color, calibration is carried out with respect to a representative print head or nozzle array, and by applying the obtained density correction values to other print heads or nozzle arrays as well.

As mentioned above, however, regarding the case where ejection characteristic differences exist between each print head or each nozzle array, in setups in which calibration is carried out only with respect to a representative print head or nozzle array and the resultant obtained density correction values are applied to other print heads or the like, it is evident that a suitable density correction is not possible. In response to this, it is thought to obtain density correction values for each print head or each nozzle array. However, in the case where the utilization ratios of the plurality of print heads or nozzle arrays differ at each print area, the density correction amounts, which differ for each nozzle array, are expressed as densities according to the utilization ratios at each print area, and a new problem of generation of density unevenness among print areas is produced.

For example, in printing apparatuses that carry out printing by scanning a print head, which arranges nozzle arrays such that a plurality of nozzle arrays overlap each other in the direction that intersects the alignment direction of the nozzles, when the utilization ratios of the plurality of nozzle arrays used in printing differ at each raster, there are times when density unevenness, appearing as shade variation in a column direction in which the nozzles are aligned, occurs.

Also, for example, as for the so-called full line method printing apparatuses as well, in which a plurality of nozzle arrays are arranged in a scanning direction of the print head relative to the print medium, when the utilization ratios of the plurality of nozzle arrays used in printing differ at each column, there are times when shade density unevenness also occurs in a raster direction.

SUMMARY OF THE INVENTION

An object of the present invention is to provide a printing apparatus and an image processing method capable of performing an appropriate density correction even in the case where the utilization ratios of the plurality of nozzle arrays used in printing differ.

In a first aspect of the invention, there is provided a printing apparatus that employs a print head provided with a plurality of nozzle arrays that eject ink of the same color, and performs printing by ejecting ink from nozzles of the nozzle arrays based on print data, said apparatus comprising: a print density characteristic retention unit adapted to retain a print density characteristic for each of the plurality of nozzle arrays; a nozzle array contribution ratio establishing unit adapted to establish a contribution ratio for each of the nozzle arrays, which print a predetermined print area; and a correction unit adapted to correct the print data based on the print density characteristics for each of the plurality of nozzle arrays and the contribution ratios for each of the plurality of nozzle arrays.

In a second aspect of the invention, there is provided an image processing method for the generation of image data, which is used for printing that employs a print head provided with a plurality of nozzle arrays that eject ink of the same color, and ejecting ink from nozzles of the nozzle array based on print data, said method comprising: a print density characteristic retention step that retains a print density characteristic for each of the plurality of nozzle arrays; a nozzle array contribution ratio establishing step for establishing a contribution ratio for each of the nozzle arrays, which print a predetermined print area; and a correction step that corrects the print data based on the print density characteristics for each of the nozzle arrays and the contribution ratios for each of the nozzle arrays.

According to the above configuration, it is possible to perform density correction of respective nozzle arrays according to the utilization ratios of the nozzle arrays used in printing, and it is possible to reduce the density unevenness or the color unevenness produced by a difference in the ejection characteristics of the plurality of nozzle arrays.

Further features of the present invention will be become apparent from the following description of exemplary embodiments (with reference to the attached drawings).

BRIEF DESCRIPTION OF THE DRAWINGS

FIGS. 10A-10D are figures for explaining the creation, for each raster, of contribution ratio tables of a first embodiment of the present invention;

FIGS. 12A-12E are figures for explaining the establishment of contribution ratio tables for each raster of a second embodiment of the present invention;

FIGS. 14A-14D are figures for explaining the establishment of contribution rate tables for each raster of a third embodiment of the present invention.

DESCRIPTION OF THE EMBODIMENTS (First Embodiment)

Embodiments of the invention will be described in detail below with reference to the drawings.

Figure 1:
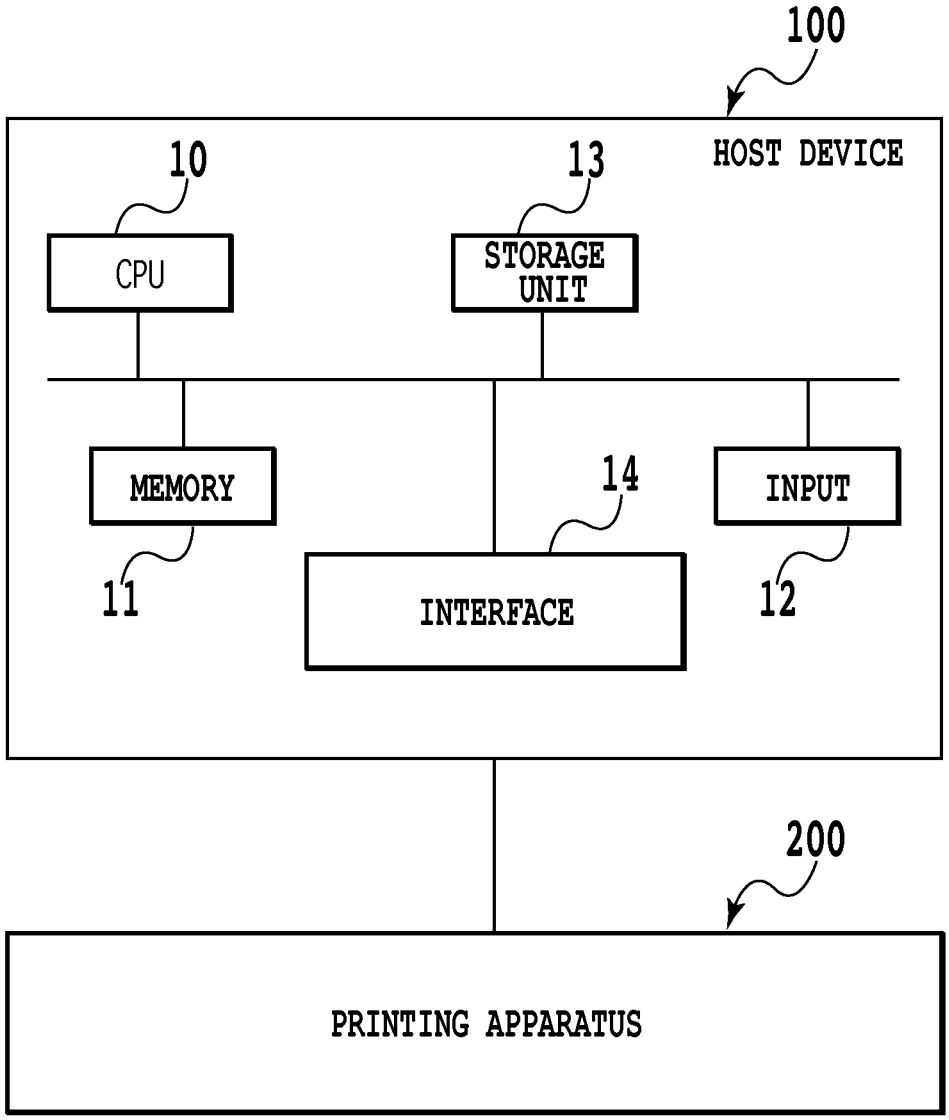
FIG. 1 is a block diagram illustrating the configuration of a printing system, which includes a printing apparatus and a host system, of an embodiment of the present invention.

FIG. 1 is a block diagram illustrating the configuration of the printing system of a first embodiment of the invention. The host device 100 is a data processing device such as a personal computer or a digital camera, and is connected to a printing apparatus 200. The host device 100 is provided with an interface 14 for communication between the CPU 10, memory 11, storage unit 13, input 12 such as a keyboard or mouse, and the printing apparatus 200. The CPU 10 is for the execution of various processes according to programs stored in the memory 11. These programs are supplied from an external device such as a CD-ROM for storing by the storage unit 13 and are stored in advance in the storage unit 13.

The host device 100 is connected to the printing apparatus 200 through the interface 14, and transmits print data expressed as R', G' and B' in the later described image processing operation, and an image processing table, to the printing apparatus 200. The printing apparatus 200, based on the transmitted image processing information, executes the later described image processing such as color processing, and binarization, and the print characteristic correction process that relates to the present embodiment. It can also carry out the printing of data subjected to image processing.

Figure 2:
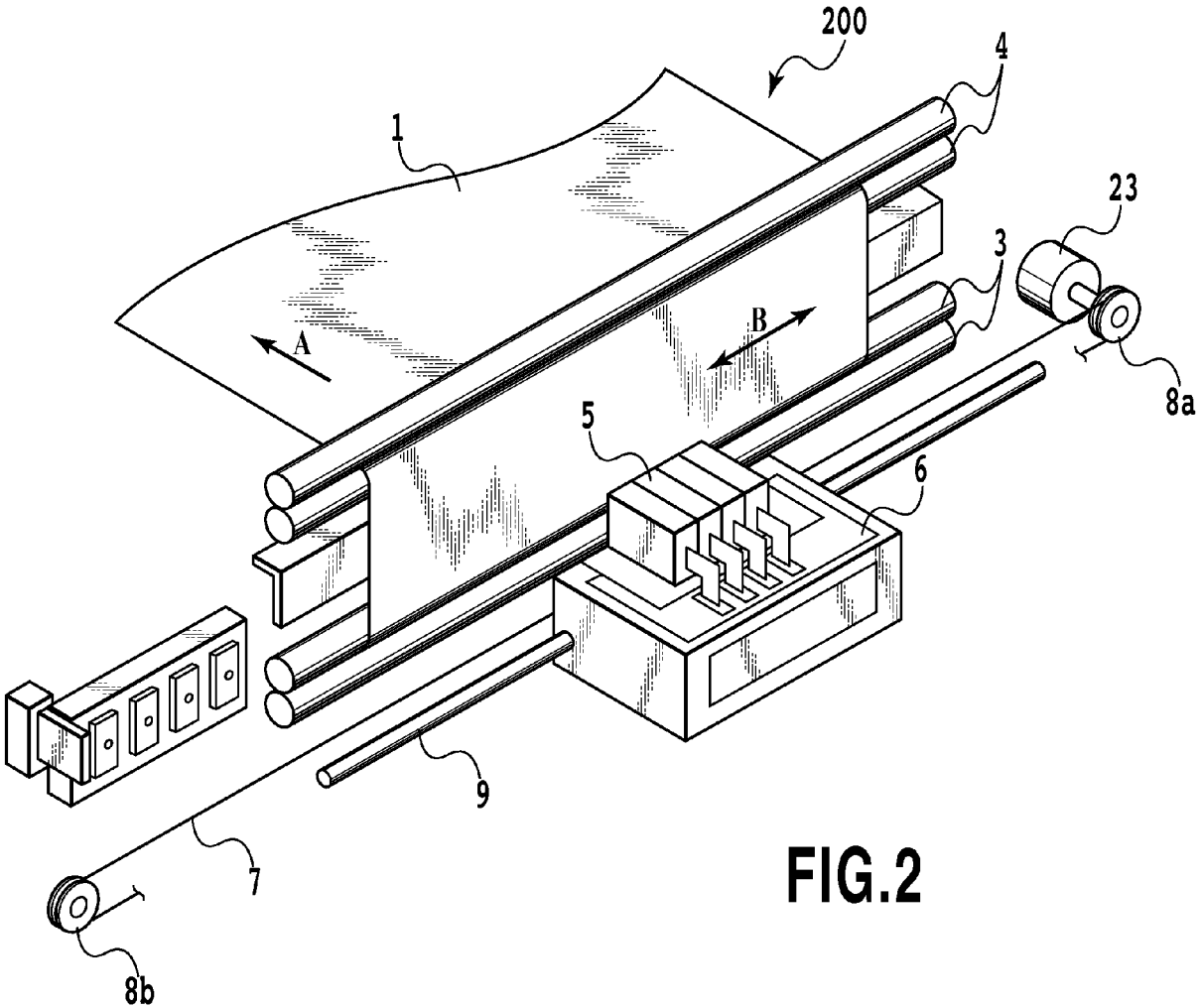
FIG. 2 is a perspective view of the printing apparatus used in the printing system of FIG. 1.

FIG. 2 is a schematic perspective view illustrating the mechanical configuration of the printing apparatus 200. Multiple sheets of a print medium 1, such as a sheet of printing paper or a plastic sheet, are stacked in a layer in a cassette (not shown) and, upon printing, separated into individual sheets and supplied by a paper feeding roller (not shown). The fed print medium is fed a prescribed distance in the direction of the arrow A (herein also referred to as the conveying direction and the sub-scan direction) at a timing in accordance with the scans of the print head, by a first conveying roller 3 and a second conveying roller 4, which are arranged such that they are separated by a prescribed interval. The first conveying roller 3 is composed of a pair of rollers; a driving roller driven by a stepping motor (not shown), and a secondary roller that rotates along with the rotation of the driving roller. The second conveying roller is composed of a pair of rollers in the same manner. It should be noted that, besides print media cut to a prescribed size and stacked in a cassette, it is also possible for the printing apparatus 200 to print roll type print media.

The print head 5 mounted in the carriage 6 is an ink-jet type print head that performs printing by ejecting ink of each of the colors Y, M, C and K. In the present embodiment, multiple separate print heads are formed into one integrated print head 5. Each of the print heads forming the integrated print head 5 has an array of nozzles. In the print head 5, ink is supplied from an ink cartridge (not shown). The print head 5, byway of being driven in response to ejection signals, ejects ink of each color from the respective nozzles (ejection openings) forming the nozzle arrays. That is, inside each of the nozzles that eject ink, an electro-thermal conversion element (heater) is installed, a bubble is generated in the ink using heat energy generated from driving the electro-thermal conversion element in response to ejection signals, and ink is ejected by the pressure from the bubble.

The driving force of the carriage motor 23 is transmitted to the carriage 6 through the belt 7 and pulleys 8*a* and 8*b*. Hence, the carriage 6 reciprocates in the direction of the arrow B (hereinafter referred to as the main scan direction) along the guide shaft 9, and thus scanning of the print head 5 can be performed. A later described multipurpose sensor is mounted on the side of the carriage 6. The multipurpose sensor is used, for example, to detect the density of ink ejected onto the print medium, to detect the width of the print medium, and to detect the distance between the print head and the print medium.

In the above configuration, the print head 5 can carry out formation of ink dots and printing on the print medium 1 by ejecting ink from the print head in response to ejection signals while scanning back and forth in the main scan direction (hereinafter also called print scanning). As necessary, the print head 5 moves to the home position and recovers from a state of improper ink ejection due, for example, to clogging of ejection openings, by way of the performance of a recovery operation by an ejection recovery apparatus installed at the home position. After the printing scan by the print head 5, the conveying rollers 3 and 4 are driven and the print medium 1 is conveyed a prescribed distance in the direction of the arrow A. It is possible to carry out printing of images and the like on the print medium 1 by way of alternately repeating print scans of the print head 5 and conveying operations of the print medium.

Figure 3:
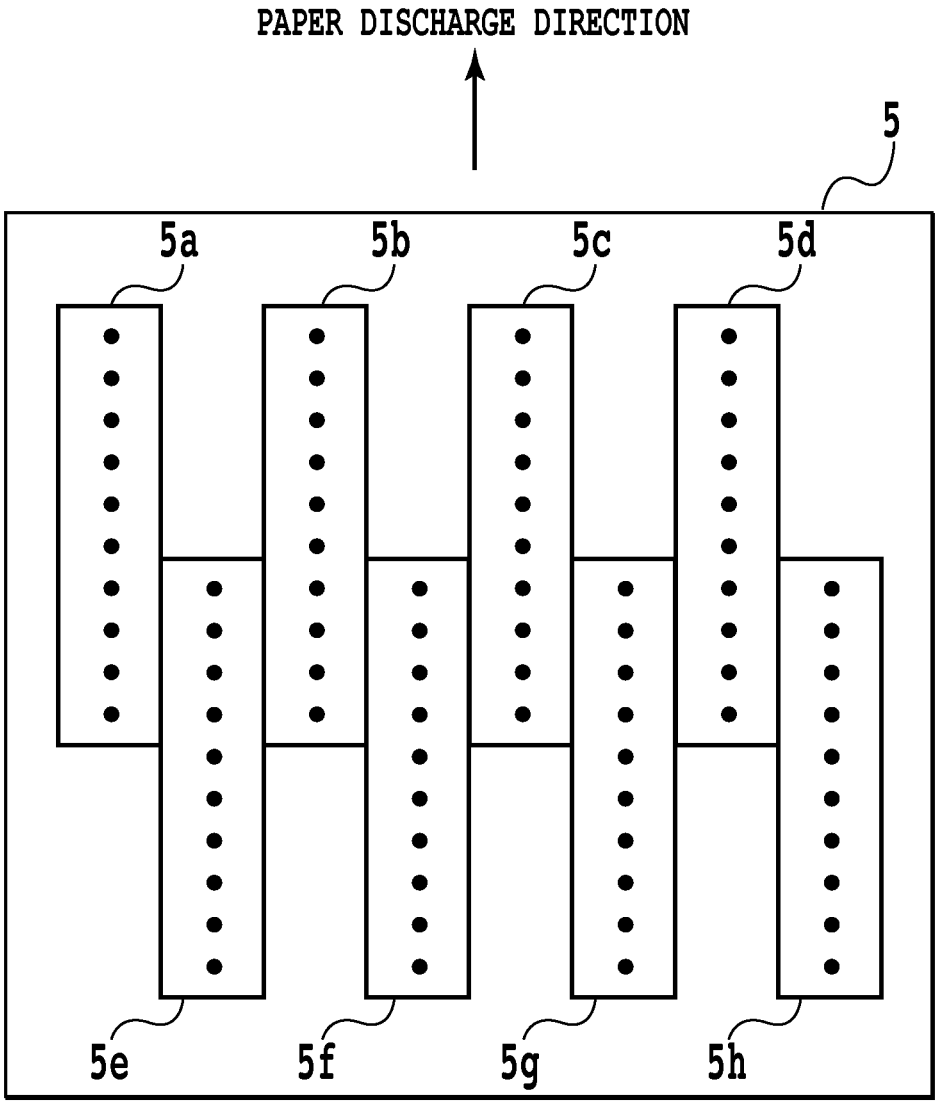
FIG. 3 is a front view showing the ejection opening face of the print head installed in the printing apparatus of FIG. 2.

FIG. 3 is a front view of the face of the print head 5 on which the ink ejection openings (nozzles) are disposed. The printing apparatus of the present embodiment has a print head provided with multiple nozzle arrays ejecting ink of the same color. In the print head 5 of FIG. 3, four nozzle arrays 5*a*, 5*b*, 5*c* and 5*d* (hereinafter also simply called nozzle group or upper nozzle group) are arranged on the upper section, facing the direction in which the print medium is discharged. Nozzle arrays 5*e*, 5*f*, 5*g* and 5*h* (hereinafter also simply called nozzle group or lower nozzle group) are arranged on the lower section, facing the direction in which the print medium is discharged. Cyan (C) ink from nozzle groups 5*a* and 5*e*, magenta (M) ink from nozzle groups 5*b* and 5*f*, yellow (Y) ink from nozzle groups 5*c* and 5*g* and black ink from nozzle groups 5*d* and 5*h* are respectively ejected. It should be noted that the types of ink colors available are not limited to these types. It should also be noted that the nozzle groups, formed on each of the print heads that form the integrated print head 5, are not limited to 2 groups of upper nozzles and lower nozzles, but rather 3 or more groups may also be arranged.

In this manner, the configuration of the print head 5 of the present embodiment is such that nozzle arrays of each ink color are arranged in the scanning direction, as a plurality of print heads that correspond to a plurality of ink colors. In the present embodiment, among the multiple nozzle arrays, each of the upper nozzle group 5*a* and lower nozzle group 5*e*, the upper nozzle group 5*b* and lower nozzle group 5*f*, the upper nozzle group 5*c* and the lower nozzle group 5*g*, and the upper nozzle group 5*d* and the lower nozzle group 5*h*, each arranged in the up-down direction in the figure, respectively eject ink of the same color. Furthermore, upper nozzle group 5*a* and lower nozzle group 5*e*, upper nozzle group 5*b* and lower nozzle group 5*f*, upper nozzle group 5*c* and lower nozzle group 5*g*, and upper nozzle group 5*d* and lower nozzle group 5*h* are arranged such that they have portions that overlap (overlap portions) in the scanning direction.

Figure 4:
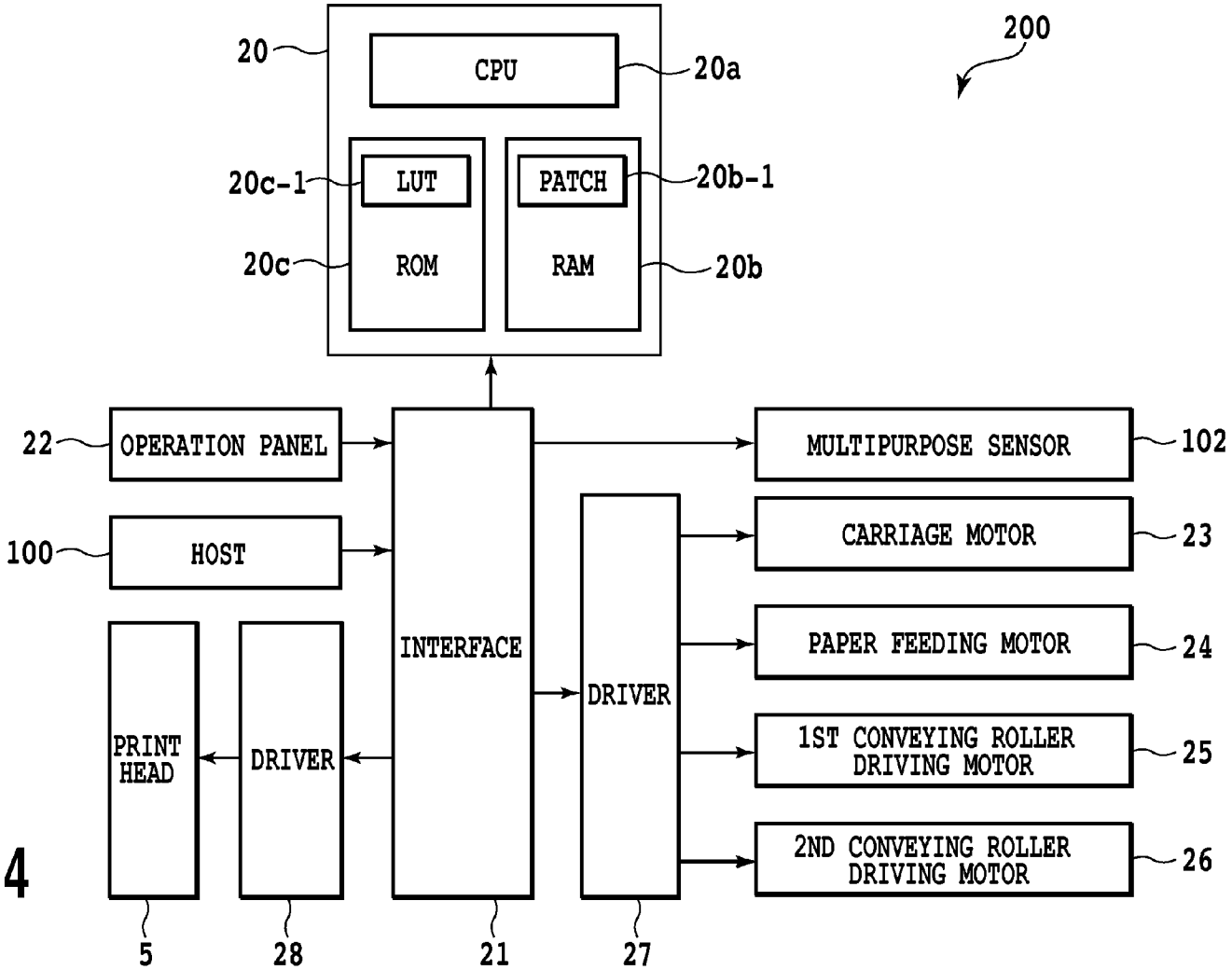
FIG. 4 is block diagram illustrating the control structure of the printing apparatus used in the printing system of FIG. 1.

FIG. 4 is a block diagram illustrating the control structure of the printing apparatus 200. The controller 20 is provided with a CPU 20*a* such as a microprocessor and memory such as a ROM 20*c* and a RAM 20*b*. The ROM 20*c* stores all types of data such as control programs of the CPU 20*a* or parameters necessary in the printing operation. The RAM 20*b* is used as a work area of the CPU 20*a* and carries out the temporary storage of all types of data such as image data received from the host device 100 or generated print data. A LUT (look up table), to be described later using FIG. 7, and patch data for printing patches are stored in the ROM 20*c* and the RAM 20*b*, respectively. It should be noted that the LUT may be stored in the RAM 20*b* and the patch data may be stored in the ROM 20*c*.

The controller 20, through the interface 21, carries out input and output processing of data and parameters, which are used in the printing of images and the like, between it and the host device 100, and input processing of all types of information (for example, character pitch, character type etc.) from the operation panel 22. The controller 20, through the interface 21, also outputs ON and OFF signals for driving each of the motors 23 to 26. Furthermore, it outputs ejection signals and the like to the driver 28, controlling the driving of ink ejection at the print head.

The control system has an interface 21, an operation panel 22, a multipurpose sensor 102, and drivers 27 and 28. The driver 27, in accordance with instructions from the CPU 20*a*, drives the carriage driving motor 23, the paper feeding roller driving motor 29, the first motor 25 that drives a pair of conveying rollers, and the second motor 26 that drives another pair of conveying rollers. The driver 28 drives the print head 5.

Figure 5A:
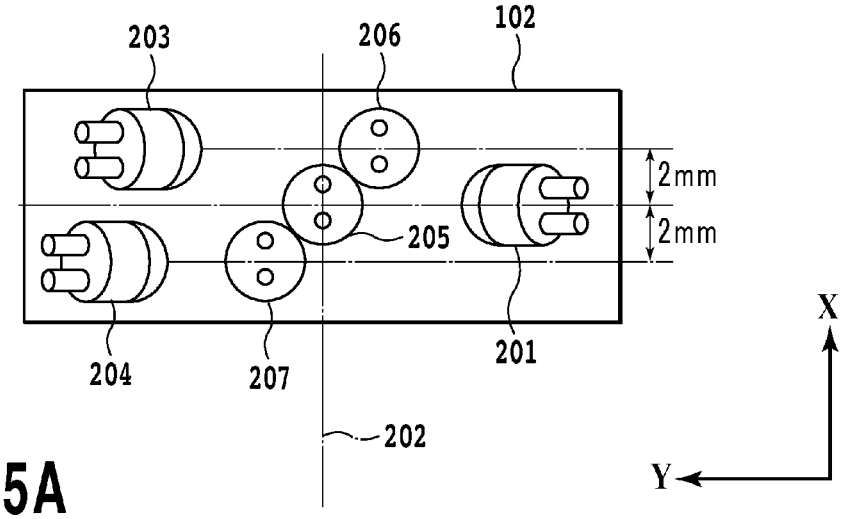
FIG. 5A is a plan view of the multipurpose sensor installed in the printing apparatus of FIG. 1
Figure 5B:
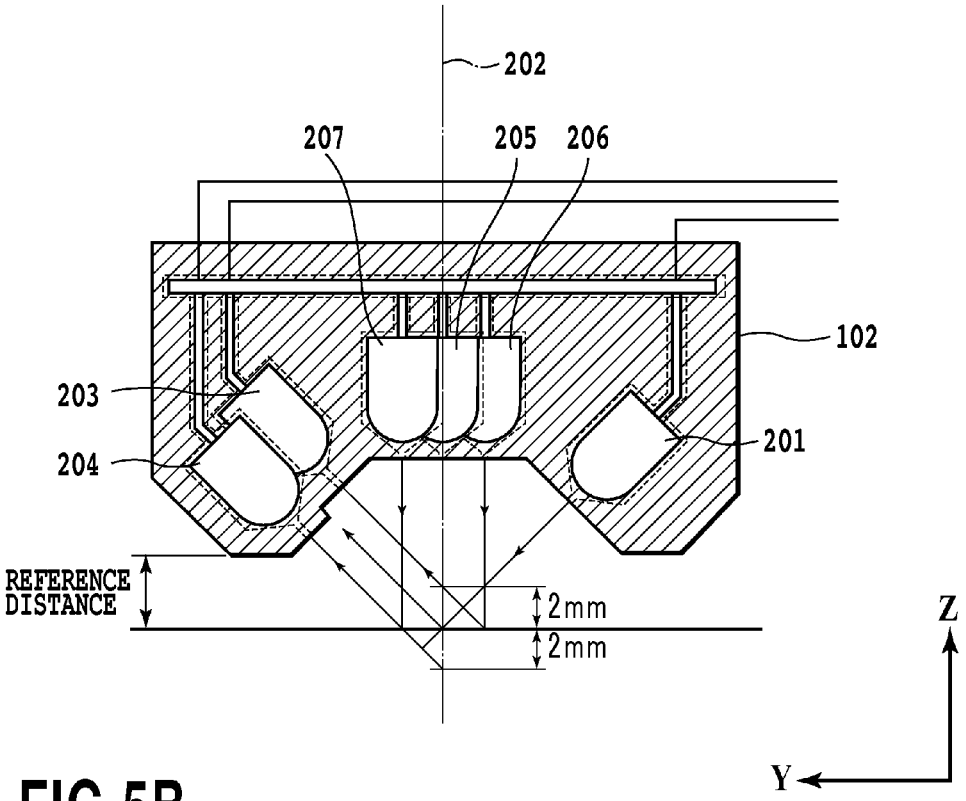
FIG. 5B is a schematically illustrated cross sectional view of the same.

FIGS. 5A and 5B are structural diagrams illustrating the multipurpose sensor 102. A plan view and a cross sectional view are shown respectively in FIGS. 5A and 5B.

Along the path in which the print medium is conveyed, the multipurpose sensor 102 is positioned downstream of the area printed by the print head 5, and the bottom surface of the multipurpose sensor 102 is arranged to be at the same level or higher than the bottom surface of the print head 5. The multipurpose sensor 102 is provided with two phototransistors 203 and 204 serving as optical elements, 3 visible LEDs 205, 206 and 207, and 1 infrared LED 201, and the driving of each of these elements is carried out by an external circuit (not shown). All of these elements are shell type elements with a diameter of approximately 4 mm at their largest portions (typical Φ3.0-3.1 mm size, mass production type).

It should be noted that, in the present embodiment, the straight line that links the center of the area irradiated by light radiated from a light emitting element towards the measuring surface, and the center of the light emitting element, is called the optical axis of the light emitting element or the illumination axis. This illumination axis is also at the center of the light beam of the radiated light.

The infrared LED 201 is at a 45 degree exposure angle with respect to the surface of the print medium (measurement surface), which is parallel to the XY plane. Thus its illumination axis, which is at the center of the irradiated light, is arranged such that it intersects with the central axis 202 of the sensor, which is parallel to the normal vector of the measurement surface (Z axis), at a prescribed location. The location along the Z axis of this crossing point (point of intersection) is taken as a reference point, and the distance from the sensor to this reference point is taken as a reference distance. The width of the light radiated from the infrared LED 201 is regulated by an aperture, and is optimized such as to form an exposed surface (exposed area) with a diameter of approximately 4 to 5 mm at the measurement surface, which is at the reference point.

The two phototransistors 203 and 204 can detect light with wavelengths from the visible spectrum to the infrared spectrum. When the measurement surface is at the reference position, the phototransistors 203 and 204 are arranged such that their light reception axes are parallel to the reflection axis of the LED 201. More specifically, the light reception axis of the phototransistor 203 is arranged such that it is at a position shifted +2 mm in the X direction and +2 mm in the Z direction with respect to the reflection axis. The light reception axis of the phototransistor 204 is arranged such that it is at a position shifted −2 mm in the X direction and −2 mm in the Z direction. When the measurement surface is at the reference position, the points of intersection between the measurement surface and the illumination axes of the infrared LED 201 and the visible LED 205 coincide, and in this position the light reception areas of the two phototransistors 203 and 204 are arranged to sandwich the point of intersection. An approximately 1 mm thick spacer is inserted between the two elements, which are configured such that the light received by each does not go into the other. An aperture is also established on the phototransistor side to control the light entrance area, and its size is optimized such that only a 3 to 4 mm area of reflected light from the measurement surface, which is at the reference point, can be received. It should be noted that in the present embodiment the straight line that links the center of the region (area) on the measurement surface (the surface of the object measured) from which the light receiving elements can receive light, and the center of the light receiving elements, is called the optical axis of the light receiving elements or the light reception axis. This light reception axis is also at the center of the light beam reflected by the measurement surface and received by the light receiving elements.

In FIGS. 5A and 5B, the LED 205 is a monochromatic visible LED having a green emission wavelength (510 to 530 nm) and is installed such as to coincide with the central axis 202 of the sensor. The LED 206 is a monochromatic visible LED having a blue emission wavelength (460 to 480 nm), and as shown in FIG. 5A, is arranged at a position shifted +2 mm in the X direction and −2 mm in the Y direction with respect to the visible LED 205. Thus when the measurement surface is at the reference position, it is arranged such that the light reception axis of the phototransistor 203 intersects at the point of intersection of the illumination axis of the visible LED 206 and the measurement surface. Furthermore, the LED 207 is a monochromatic visible LED having a red emission wavelength (620 to 640 nm), and as shown in FIG. 5A, is at a position separated from the LED 205 by −2mm in the X direction and +2mm in the Y direction. When the measurement surface is at the reference position, it is arranged such that the light reception axis of the phototransistor 204 intersects at the point of intersection of the illumination axis of the visible LED 207 and the measurement surface.

Figure 6:
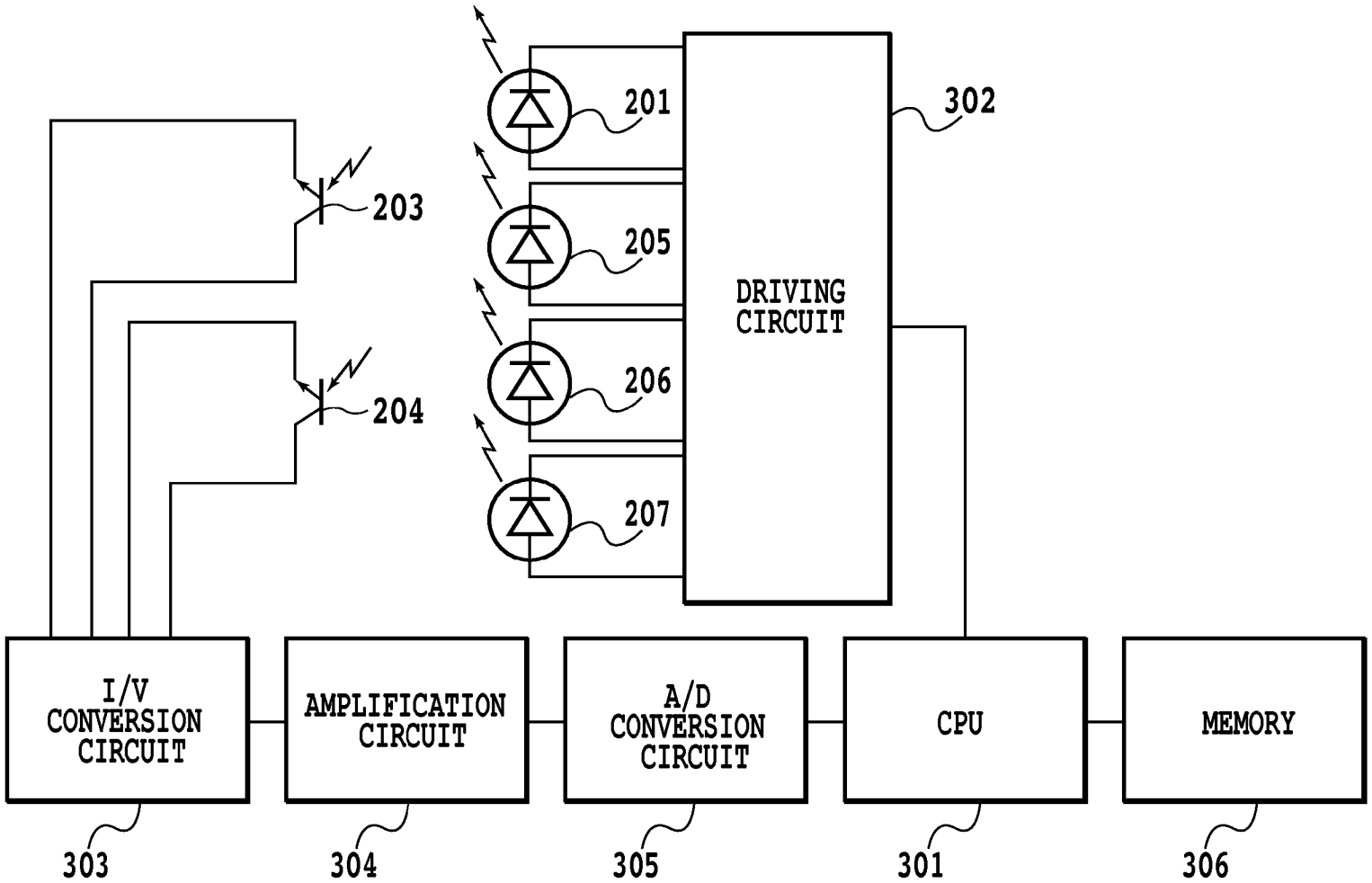
FIG. 6 is an explanatory diagram for explaining the control circuit that processes signal input and output for each of the sensors of the multipurpose sensor of FIG. 5.

FIG. 6 is a schematic view of the control circuit that processes signal input and output for each of the sensors of the multipurpose sensor 102 of the present embodiment. The CPU 301 carries out, for example, ON/OFF control signal output for the infrared LED 201 and the visible LEDs 205 to 207, and calculation of the output signals that are obtainable in accordance with the amount of light received by the phototransistors 203 and 204. The driving circuit 302 receives an ON signal sent from the CPU 301, supplies a fixed electric current to and causes each of the light emitting elements to emit light, and regulates the amount of luminescence of each of the light emitting elements such that the amount of light received by the light receiving elements reaches a prescribed amount. The I/V conversion circuit 30 converts the output signal, sent from the phototransistors 203 and 204 as an electric current value, to a voltage value. The amplification circuit 304 serves the function of amplifying the output signal, which, after conversion to a voltage value, is a minute signal, to a level that is optimal for A/D conversion. The A/D conversion circuit 305 converts output signals amplified by the amplification circuit 304 into 10 bit digital values and inputs them into the CPU 301. The memory 306 (nonvolatile memory for example) is used for the storage of reference tables for deriving measurement values from the calculation results of the CPU 301, and for the temporary storage of output values. It should be noted that the CPU 20*a* and RAM 20*b* of the printing apparatus may be employed as the CPU 301 and the memory 306.

The image processing operation for generation, at the host device 100 and the printing apparatus 200, of print data used by the printing apparatus 200 will be explained next.

Figure 7:
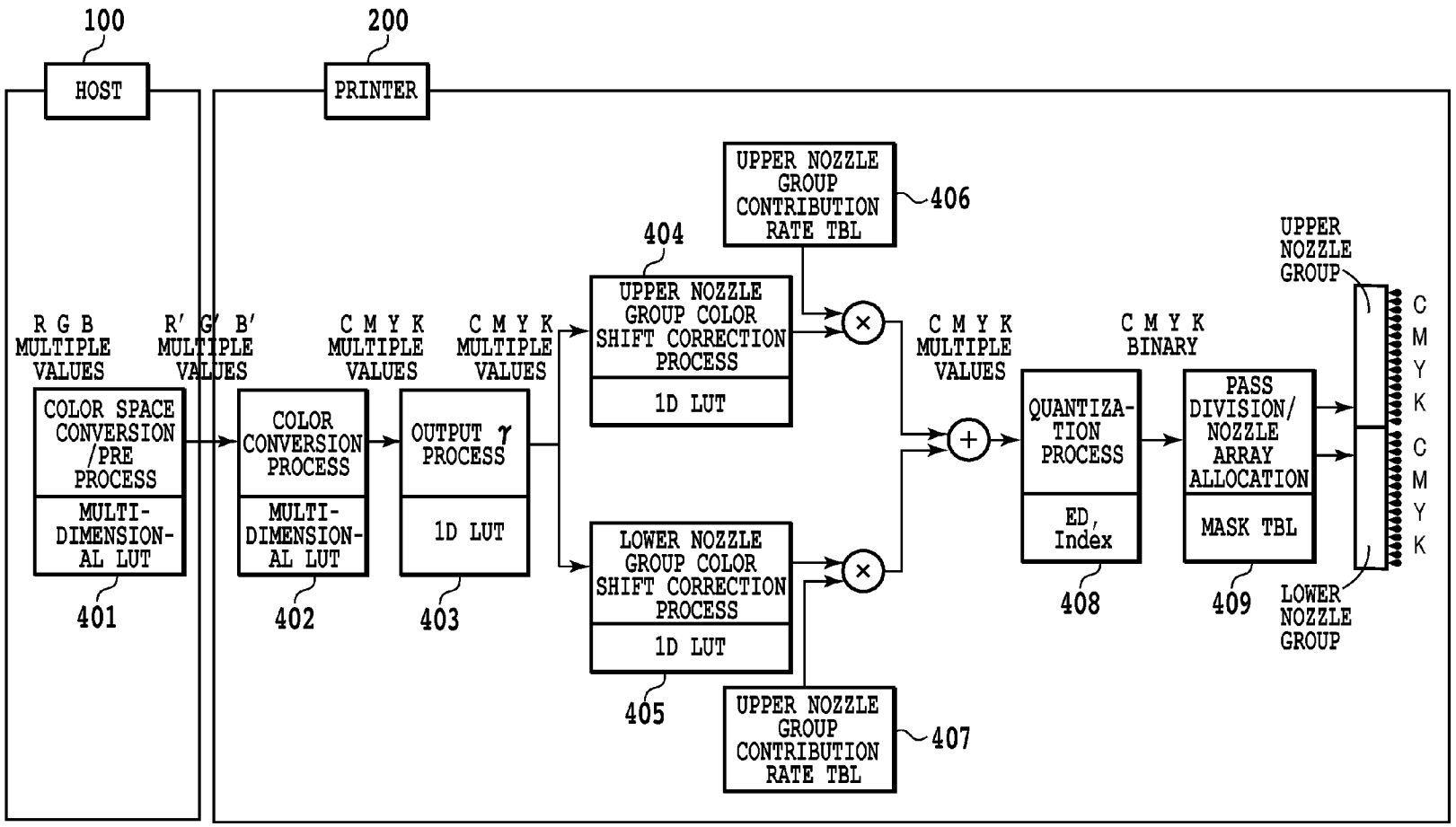
FIG. 7 is an explanatory diagram for explaining the flow of the processing of image data in the printing system of FIG. 1.

FIG. 7 is a block diagram showing the structure of the image processing operation of the present embodiment. In the image processing operation of the present embodiment, respective red (R), green (G), and blue (B) (each 256 grades) 8-bit image data (luminance data) is input, and then processing of outputting data, as 1-bit image data (print data) for each nozzle, which is to be finally printed by the nozzle groups 5*a* to 5*h*, is carried out. It should be noted that the color types and gradients are not limited to these values.

First, at the host device 100, using a multi-dimensional LUT, image data expressed as R, G, B multi-value luminance signals are converted into R', G', B' multi-value data. This color space conversion preprocess (hereinafter also referred to as pre-color processing) is carried out to adjust for the difference between the input image color space expressed by the R, G, B image data of the object to be printed and the color space capable of being reproduced at the printing apparatus 200.

Respective R', G', and B' color data, given by the pre-color process, is transmitted to the printing apparatus 200. The printing apparatus 200, first, converts respective R', G' and B' color data, received from the host device using the multidimensional LUT and given by the pre-color process, into C, M, Y, K multi-value data. This color conversion process (hereinafter also referred to as post-processing) is a process that converts input RGB type image data, expressed as a luminance signal, into CMYK type output data for expression as a density signal.

Next, as for the multi-value C, M, Y, K data given by the post-color process, a y output correction is carried out by means of a 1 dimensional LUT 403 for each of the colors. Usually there is not a linear relationship between the number of printed dots per unit area of the print medium and printing characteristics such as the reflected density acquirable after measuring the printed image. For this reason an output correction process is performed that corrects the C, M, Y, K multi-value input gradation level, such that there is a linear relationship between the respective C, M, Y, and K, 10 bit input gradation level and the density level of the printed image based on that.

As mentioned above, as for the y output correction table (the one dimensional LUT 403), tables created for use in print heads that exhibit standard printing characteristics are often used. However, as mentioned above, because there are individual ejection characteristic differences between print heads or nozzle groups, it is not possible to appropriately perform density correction with respect to all of the print heads or nozzle groups only by means of a y output correction table that corrects print characteristics of print heads or nozzle groups that exhibit standard ejection characteristics.

Because of this, in the present embodiment, a color shift correction process is carried out with respect to the multi-value C, M, Y, K data produced from the y output correction. This color shift correction process is carried out based on a one dimensional LUT 404 for color shift correction of upper nozzle groups and a one dimensional LUT 405 for color shift correction of lower nozzle groups.

Description will now be given with respect to the one dimensional LUT for use in correction of the color shifts of the respective colors. The color shift correction is configured based on density value information for each of the respective nozzle groups, acquired during a calibration process.

Figure 11:
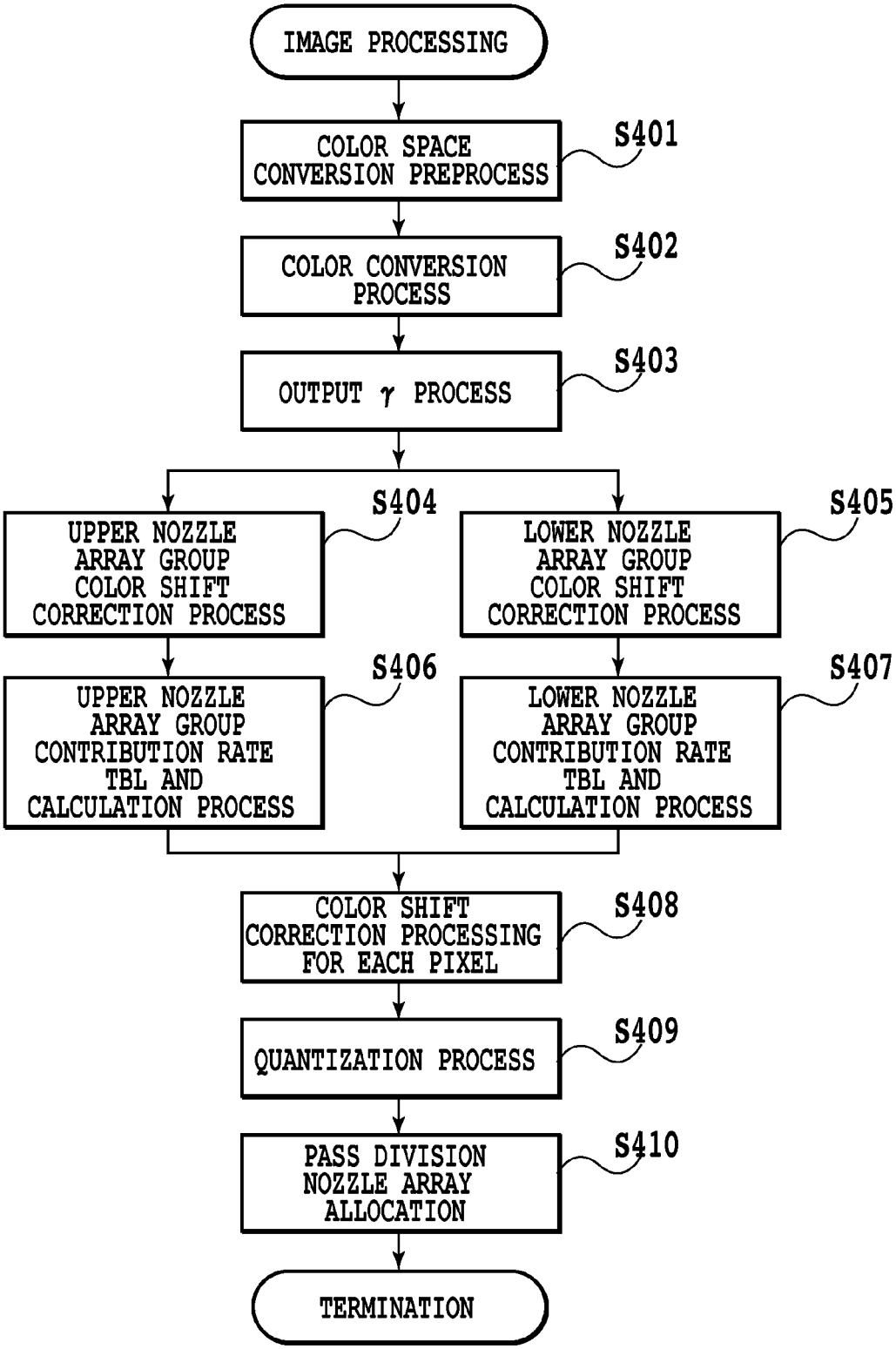
FIG. 11 is a flowchart that explains the flow of an image processing operation.

FIG. 11 is a flow chart that explains the flow of the image processing operation by the host 100 and the printer 200.

First, in the host device 100, using the multidimensional LUT 401, image data, expressed as a R, G, B multi-value luminance signal, is converted into R', G', B' multi-value data (step 401). Next, the printer 200 converts the R', G', B' data of each color, received from and subjected to pre-color processing by the host device using the multidimensional LUT 402, into C, M, Y, K multi-value data (step 402). Then, as for the C, M, Y, K, multi-valued data, subjected to post-color processing, output y correction is carried out according to one dimensional LUTs 403 for the respective colors(step 403).

Here, as for the present embodiment, with respect to the C, M, Y, K multi-value data, an upper nozzle group color shift correction process is carried out based on the one dimensional LUT 404 for upper nozzle group color shift correction (step 404), and a lower nozzle group color shift correction process is carried out based on the one dimensional LOT 405 for lower nozzle group color shift correction (step 405).

Next, for each image pixel, a logical AND operation is performed between the result of the upper nozzle group color shift correction process and the upper nozzle group contribution ratio table 906 that indicates upper nozzle group utilization rate information (step 406), and a logical AND operation is performed between the result of the lower nozzle group color shift correction process and the lower nozzle group contribution ratio table 407 that indicates lower nozzle group utilization rate information (step 407). A logical OR operation is then calculated between the results of the logic AND operations of steps 406 and 407, and, at each image pixel, a color shift correction process is carried out (step 408).

Next, a quantization operation 408 is performed on the respective calculated C, M, Y, K multivalue data by way of a halftoning process such as dithering, error diffusion, or the like, and an index expansion, and converted into respective C, M, Y, K binary data (step 909). After that, based on a mask pattern or the like, a pass division and upper and lower nozzle group allocation operation 410 is performed, and upper nozzle group data printed by the upper nozzle group and lower nozzle group data printed by the lower nozzle group are generated.

Figure 8:
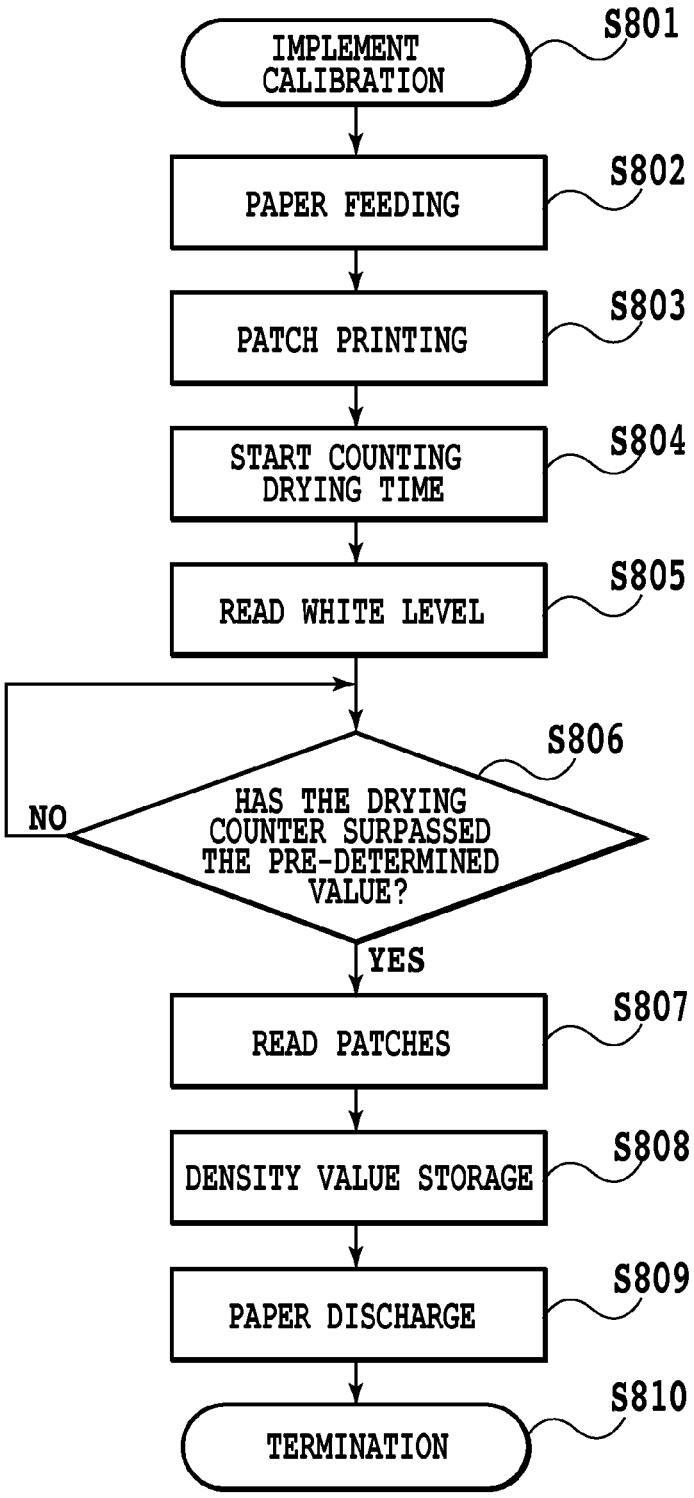
FIG. 8 is a flowchart for explaining the flow of the processes of the printing apparatus of a first embodiment of the present invention, from the commencement of patch printing to density measurement.

FIG. 8 is a flowchart showing the operational flow of the printing apparatus 200 in respect to the calibration process.

A calibration start command, which prints a patch and measures density, is input from, for example, the input 12 of the host device 100, the CPU 12 or the operation panel 22 of the printing apparatus 200 (step 801). When the calibration process execution instruction is input, the CPU 20*a* of the printing apparatus 200 drives the paper feeding motor 24 and commences the supply of a print medium from the paper feeding tray (step 802). When the print medium is conveyed to an area where printing by the print head is possible, conveying operations, in the sub-scan direction, of the print medium, and printing scans in the main scan direction of the carriage 6 driven by the carriage motor 23, are alternately performed. Next, the print head 5, as a patch printing means, prints, on the print medium, the number of patches (test patterns) necessary for calibration (step 803). In the present embodiment, patches A, B, C, D, E, F, G and H are printed by this patch printing process.

Figure 9:
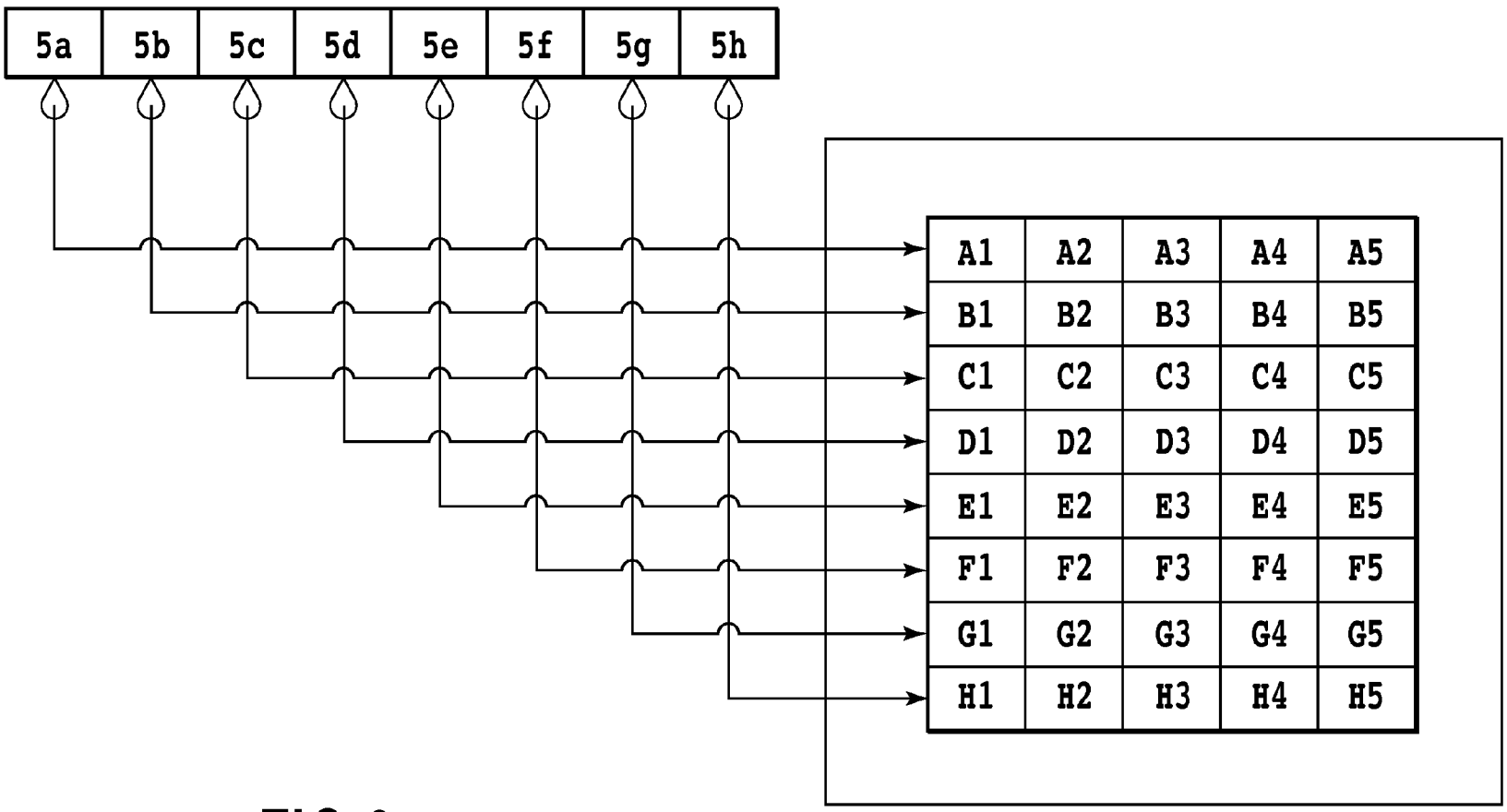
FIG. 9 is an explanatory diagram for explaining the correspondence between the nozzles arrays and patches of a first embodiment of the present invention.

FIG. 9 is a schematic view illustrating the patches of the present embodiment. The respective alphabetic characters, from A to H, printed on the color patches of each ink color, which compose the a patch pattern, are symbols to denote the patches printed by ink ejected from the nozzle groups 5*a* to 5*h* shown in FIG. 3. The numbers 1 to 5 are numbers ranking the density gradation of the printed color patches. That is, for example, patch A1 is a density gradation 1 patch printed by the upper nozzle group nozzle array 5*a*, which ejects cyan ink. It should be noted that gradation levels are not limited to 5, and that there need not be a relation between number size and gradation height.

Next, in order to allow the printed patch to dry, a time counter is started, for waiting a predetermined time period (step 804). Next, in order to determine the white level (the base color of the print medium), measurement of the reflected light intensity where the patch is not printed is performed, making use of the multi-purpose sensor 102 (step 805). The result of this white level measurement is used as a reference white during calculation of the density of the later printed patch. For this reason respective white level values are retained for each LED. Herein, as for the density of the blank portion of the print medium where patches are not printed, if the base color of the print medium is measured and the print medium is white, then the base color is white. In the present embodiment examples are explained using a print medium with a white base color.

After confirmation that the counter of the drying timer has surpassed a predetermined time (step 806), reflected light density measurement of patches A, B, C, D, E, F, G and H is commenced (step 807). The reflected light density measurement is carried out by, among the LEDs 205 to 207 mounted in the multi-purpose sensor 102, lighting a LED appropriate for the color of the ink whose density is being measured, and reading the reflected light via phototransistors 203 and 204, which serve as measurement means for the measurement of patch density. The green LED 205, for example, is lit when measuring a patch printed by M ink, or a blank portion (white colored) where no patch is printed. Likewise, the blue LED 206, for example, is lit when measuring a patch printed by Y ink or K ink, or a blank portion (white colored) where no patch is printed. Again, the red LED 207, for example, is lit when measuring a patch printed by cyan ink, or a blank portion (white colored) where no patch is printed.

When the patches have finished being read, based on the values output from both the respective patches and blank portions (white colored), patch density values are calculated and each of the patch density values is stored in the memory 306 inside the main body of the printing apparatus or the RAM 20*b* (step 808). After that discharging of the print medium is performed (step 809) and the processing is terminated (step 810).

The contents of the color shift correction process are next updated based on the above mentioned measured density values. As for the present embodiment, correction processing is carried out with respect to the color shift correction one dimensional LOT, which is configured in advance and used in color shift correction processing. Here, the measured density values of each patch, which are obtained from the density measurement, and prescribed landmark densities, which are determined in advance and called target values, are compared, and density correction values are calibrated such that the densities of patches at the time of printing approach the target values. As for the target values, it is also possible to, in advance, print patches using a satisfactory high precision ink jet printing apparatus and print head, and employ the values obtained upon measuring density. In this manner, the target values are values that are extremely close to ideal values. Here, for example, the CPU 10 of the host 100 or the CPU 20*a* of the printing apparatus 200 (table establishing means) produces the one dimensional LUTs for color shift correction. One dimensional LUTs for color shift correction are produced for each type of print medium or resolution, and the produced one dimensional LUTs for color shift correction are stored in the memory of the main body of the printing apparatus.

When this kind of calibration is carried out, in the case where the ejection characteristic balance between each of the nozzle groups of the print head is not desirable when compared to the balance of a print head that exhibits suitable ejection characteristics, a one dimensional LUT table is selected such that they approach the suitable ejection characteristics.

For example, suppose that the ejection characteristic output value of the nozzle group 5*a*, which ejects a cyan colored material, has become small. In this case, among the multiple color shift correction one dimensional LUTs 404, each differing in correction values, a one dimensional LUT table is selected and configured such that the output value of the cyan component becomes a value that is higher than that of the input value. Due to carrying out calibration in this manner, even if using a print head in which less cyan colored material is applied, a correction is performed in which the output value for ejection of cyan colored material becomes larger, such that colors are reproduced that are the same as that of a print head that exhibits standardized printing characteristics.

Again, for example, similarly suppose that the ejection characteristic output value of the nozzle group 5*e*, which ejects cyan colored material, has become large. In this case, among the multiple color shift correction one dimensional LUTs 405 each differing in correction values, a one dimensional LUT table is selected and configured such that the output value of the cyan component becomes a value that is lower than that of the input value. Due to carrying out calibration in this manner, even if using a print nozzle group 5*e* in which more cyan colored material is applied, a correction is performed in which the output value for ejection of cyan colored material becomes smaller, such that colors are reproduced that are the same as that of a print head that exhibits standardized printing characteristics.

It should be noted that as for the one dimensional LUT for color shift correction, separate one dimensional LUTs for color shift correction may be produced for each usage environment. Also, as for the one dimensional LUTs for color shift correction, without creating and storing them at the time of calibration, they may be created each time during the image processing operation at the time of image printing. Furthermore, based on the patches printed by the patch printing means, a table that has been produced in advance may also be selected.

In the present embodiment, the one dimensional LUTs for color shift correction are established in the above manner, based on density information of patches printed by each of the nozzle groups.

Configuration of the nozzle group contribution ratio table, which is a nozzle array contribution ratio establishment means that establishes printing ratios, will be explained next while making use of FIGS. 10A to 10D.

Figure 10A:
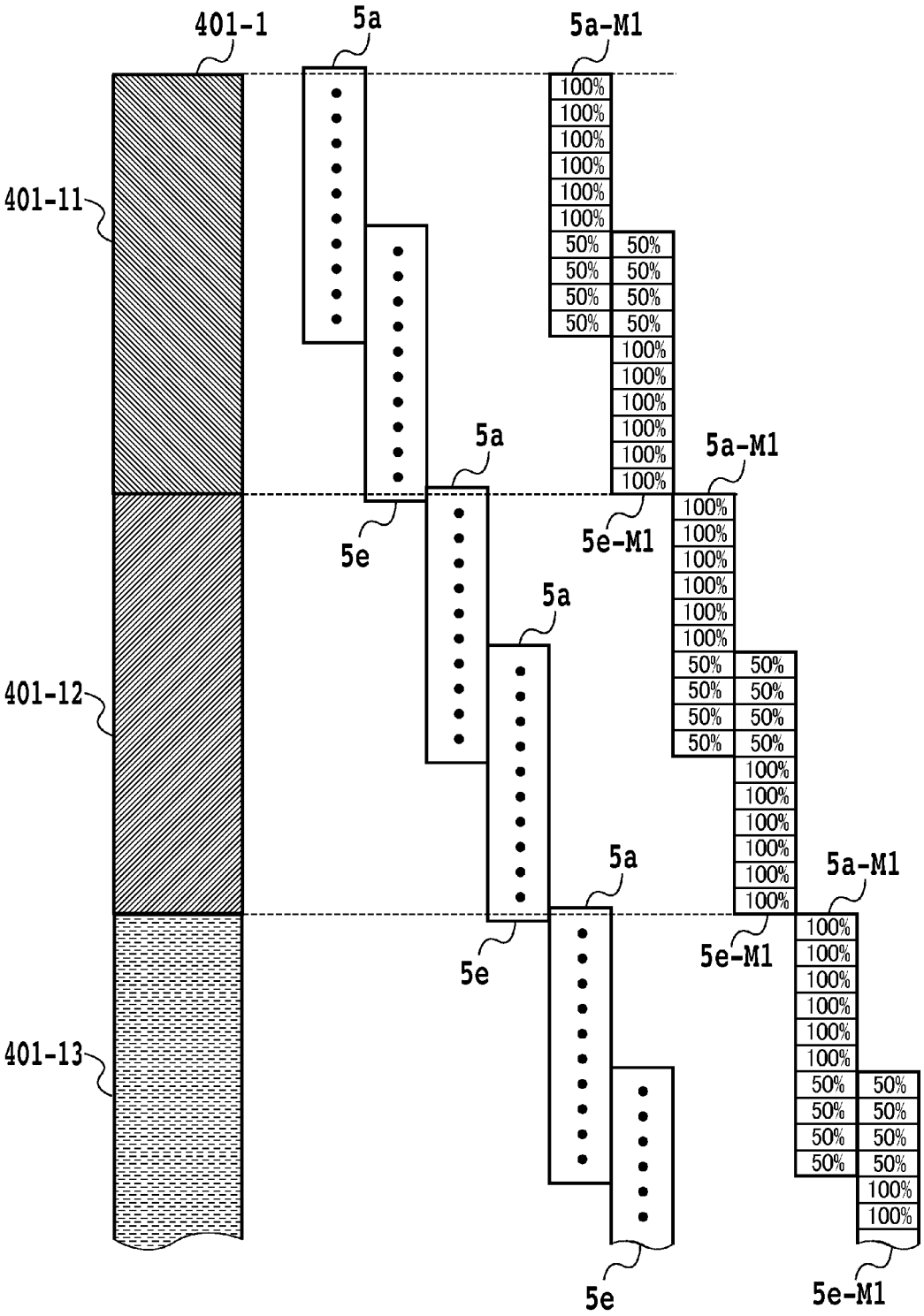

FIG. 10A illustrates image data at respective regions; image data for the region 401-11 is printed in the first pass, image data for the region 401-12 is printed in the second pass, and image data for the region 401-13 is printed in the third pass. FIG. 10A illustrates the nozzle group 5*a* composed of 10 nozzles that eject cyan ink and the nozzle group 5*e* composed of 10 nozzles that similarly eject cyan ink. The nozzle group 5*a* and the nozzle group 5*e* are configured such that four nozzles overlap with each other in the scan direction. FIG. 10A also shows mask tables 5*a*-M1 and 5*e*-M1, for the respective nozzle groups 5*a* and 5*e* illustrated in FIG. 10A. More specifically, with respect to regions in which printing is carried out only by the nozzle group 5*a* or the nozzle group 5*e*, print data is allocated, without change, to the nozzle group 5*a* or the nozzle group 5*e*. On the other hand, print data is allocated at 50% each to the overlapped portions of the nozzle group 5*a* and the nozzle group 5*e*. FIG. 10B shows contribution ratios with respect to printing by the nozzle group 5*a* and the nozzle group 5*e*. Specifically, contribution ratios 5*a*-406-1 show the contribution ratios by the nozzle group 5*a* and contribution ratios 5*a*-407-1 show the contribution ratios by the nozzle group 5*e*. In the present embodiment, nozzle array contribution ratios of the nozzle array groups 5*a* and 5*e*, corresponding to the overlap portion, are both set at 50%, and as for the other nozzle array contribution ratios, the contribution ratios of one of the nozzle array groups is set at 100%.

Figure 10C:
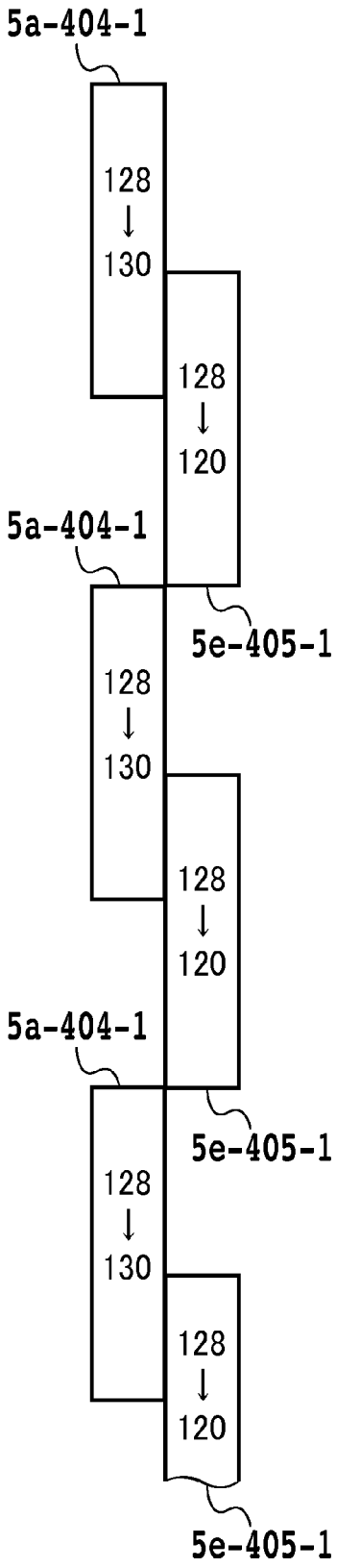

FIG. 10C, when cyan 8-bit multivalue input data is input, shows the result of the color shift correction of the upper nozzle group 5*a* and the result of the color shift correction of the lower nozzle group 5*e*. Here, an example is shown where, in the case where cyan 8-bit multivalue input data 128 is input, as in FIG. 10D, as for the upper nozzle group 5*a*, the input data 128 is corrected to 130, as an output value, and as for the lower nozzle group 5*e*, the input data 128 is corrected to 120, as an output value.

It should be noted that in the present embodiment the resolutions of the upper and lower contribution ratio table and the resolutions of the mask table are the same as the nozzle arrays but in the case where they differ a contribution ratio table is established via performing a resolution conversion calculation. For example, there are cases where the space between each nozzle of a nozzle array is 1200 dpi and the resolution of the mask table is 1200 dpi but the resolution upon carrying out color shift correction is 600 dpi and the upper and lower contribution ratio table and nozzle arrays are 600 dpi. In this case it is good to establish an upper and lower contribution ratio table for one raster, based on information from 2 rasters of the mask table.

A color shift correction process based on a color shift correction one dimensional LUT and a nozzle array contribution ratio table will be explained next. In the color shift correction process of the present embodiment, the balance between the ink ejection characteristics of each nozzle group of the print head is kept at a suitable balance by way of correcting, based on an upper and lower contribution ratio table for each raster, values based on a one dimensional LUT for color shift correction.

Figure 10D:
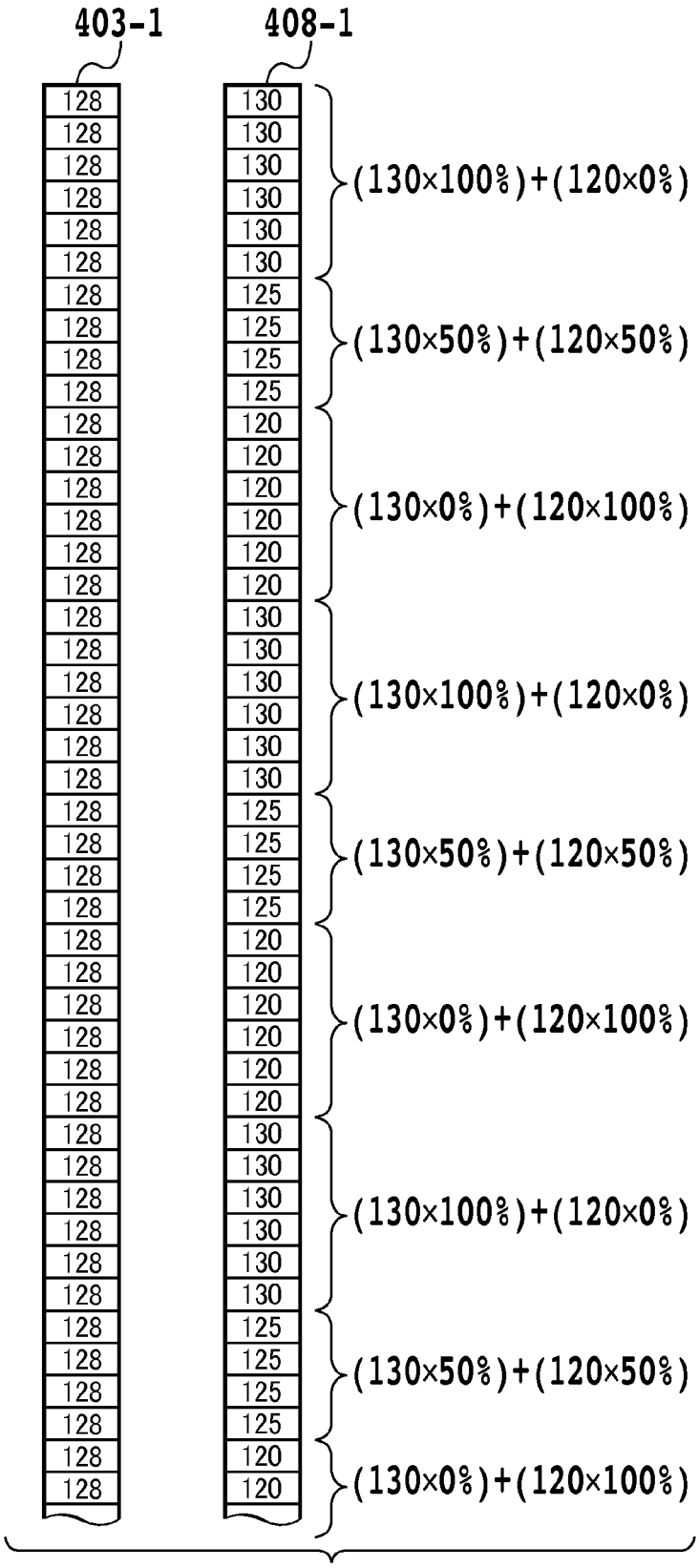

In the present embodiment a color shift correction is performed by way of allocating the results of the color shift correction, for the respective upper and lower nozzle groups, based on the contribution ratios of the respective nozzle groups. That is, the products of the color shift correction results, for the respective nozzle groups, and the contribution ratios indicating nozzle group utilization ratio information at the respective print areas, are calculated, and the sum totals of the each of these products become output values. The right hand side of FIG. 10D shows output values at each print area (herein, 1 raster units), calculated based on respective upper and lower nozzle group color shift correction LUTs and upper and lower contribution ratio tables. The present embodiment is of a printing apparatus in which two nozzle groups are arranged such that portions of nozzle groups overlap each other. Therefore the product of the color shift correction result for the upper nozzle group and the upper nozzle group contribution ratio indicating utilization information of the upper nozzle group at the print area is taken. The product of the color shift correction result for the lower nozzle group and the lower nozzle group contribution ratio indicating utilization information of the lower nozzle group at the print area is also taken. The sum of each of these results becomes the value after the color shift correction with respect to the input.

Concretely, as shown in FIG. 10C-10D, assume a case where the cyan multi-value data output by the one dimensional LUT is 128, the resultant value of the color shift correction, for the upper nozzle group, is 130, and the resultant value of the color shift correction, for the lower nozzle group, is 120. Thus, among the portions that are not overlapped, as for the region where printing is carried out by only the upper nozzle group, the nozzle utilization ratio of the upper nozzle group is 100% and the nozzle utilization ratio of the lower nozzle group is 0%. In this case, 130, the sum of 100% of 130 and 0% of 120, is the result of the color shift correction for the case where the cyan data is 128. Also, concerning the overlapped portion, 125, the sum of 50% of 130 and 50% of 120, becomes the result of the color shift correction in the case where the cyan data is 128. In this manner, according to the present embodiment, in the case where the utilization ratios of each of the plurality of nozzle groups differ at each print area, because a density correction is carried out according to those utilization ratios (contribution ratios), the print density variation at each print area can be suppressed, and as a result the density unevenness can be reduced.

Next, binary data is obtained for C, PI, Y, and K each, by way of applying a halftoning process, which makes use of the error diffusion (ED), to each of the calculated C, M, Y, and K multi-value data, and carrying out quantization (the quantization process 408), based on the index expansion. Next, making use of the mask illustrated in FIG. 10A, respective upper and lower nozzle group print data is allocated into 2 passes and the nozzle array allocation operation 409 is carried out. As for the printing operation, ink is ejected from the upper nozzle arrays based on upper nozzle array data obtained as described above, ink is injected from the lower nozzle arrays based on lower nozzle array data, and printing is carried out.

By means of the above, in the case where utilization ratios of the plurality of nozzle arrays used in printing differ, without the establishment of tables for each print head, the density unevenness correction calibration process can be implemented.

It should be noted that while in the present embodiment the LUTs 402, 403, 404, 405, 406 and 407 are retained in the printing apparatus 200, they may also be stored in advance in the ROM 20*c*, or stored in the RAM 20*b*. In the case of storing in advance in the ROM 20*c*, it is preferable to prepare in advance a plurality of LUTs, each for a single objective, and configure them such that an appropriate LUT can be selected from among them and used.

Also, in the present embodiment, at the overlap portion, the utilization ratios of the upper nozzle group 5*a* and the utilization ratios of the lower nozzle group 5*e* are 50% each across the board, but the utilization ratios of each nozzle group are not so limited. For example, at the overlap portion, the upper nozzle group 5*a* and the lower nozzle group 5*e* can be mutually set up such that utilization ratios decrease gradually as approaching the end of the nozzle group.

(Second Embodiment)

The second embodiment relates to a color shift correction process in the case of two pass printing using the print head of the first embodiment.

Figure 12A:
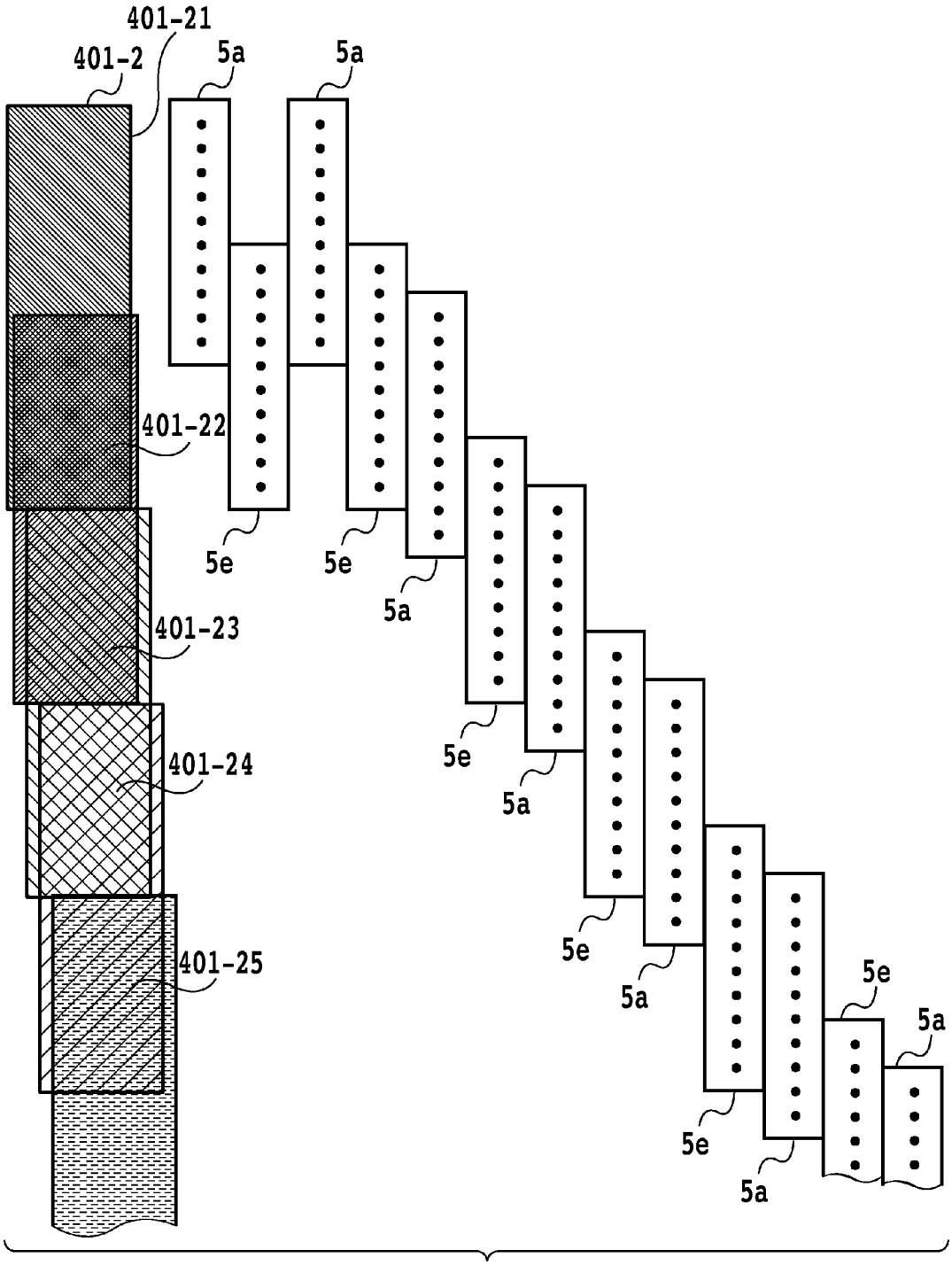

FIG. 12A illustrates image data at respective regions and the positions of the upper nozzle group 5*a* and the lower nozzle group 5*e* at each scan. Here, at the first scan, 1st pass image data is printed at the region 401-21, at the second scan, 2nd pass image data is printed at the region 401-21, and printing with respect to the region 401-21 is completed. Also, at the second scan, 1st pass image data is also printed at the region 401-22, and as for this region, at the third scan, 2nd pass print data is printed and the imaged is completed. Printing of the other regions 401-23, 401-24 and 401-25 is also performed by two pass printing in the same manner.

Figure 12B:
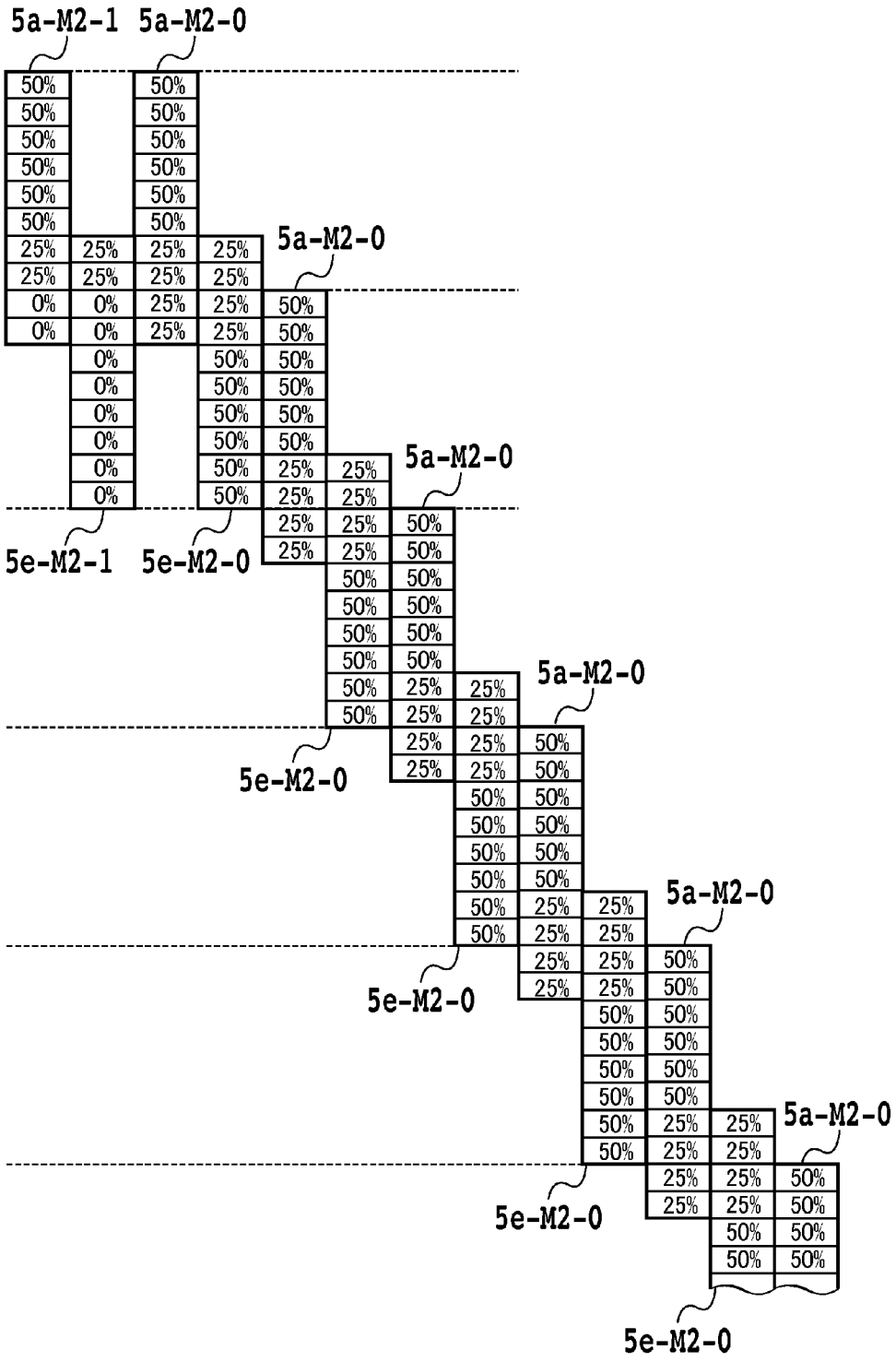

FIG. 12B shows respective mask tables 5*a*-M2 and 5*e*-M2 for the nozzle group 5*a* and nozzle group 5*e* shown in FIG. 12A. More specifically, with respect to the portion that is not overlapped, print data is allocated at 50% each to the nozzle group 5*a* and the nozzle group 5*e*. On the other hand, at the overlapped portion, print data is apportioned at 50% each to each pass, and furthermore at one pass 50% of the print data is allocated at 25% each to the nozzle group 5*a* and the nozzle group 5*e*. FIG. 12C shows contribution ratios with respect to the printing of the nozzle group 5*a* and the nozzle group 5*e*. More specifically, contribution ratios 5*a*-406-2 denote contribution ratios of the nozzle group 5*a* and contribution ratios 5*a*-406-2 denote contribution ratios of the nozzle group 5*e*.

Figure 12D:
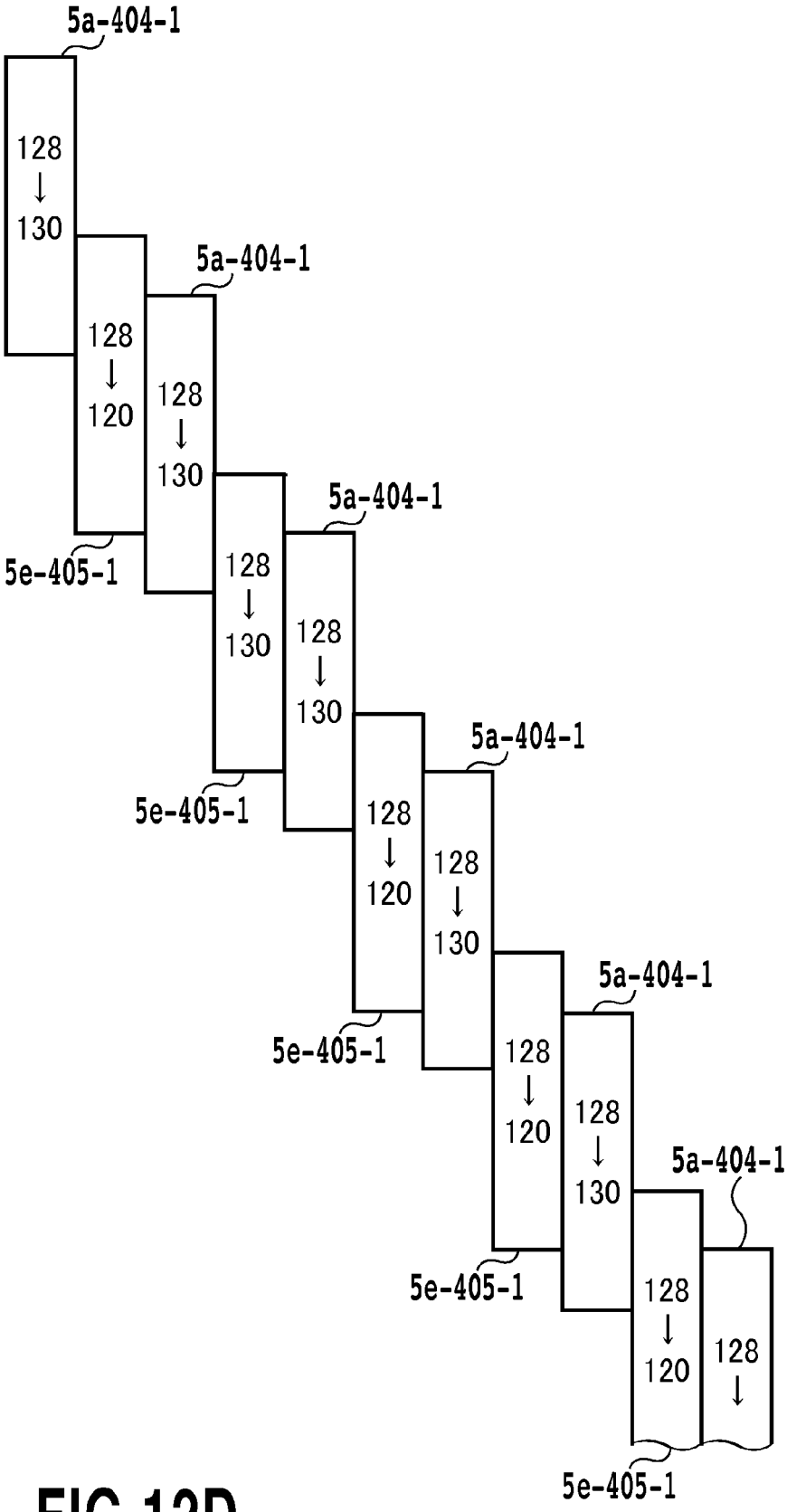

FIG. 12D, when cyan 8-bit multivalue input data is input, shows the result of the color shift correction of the upper nozzle group 5*a* and the result of the color shift correction of the lower nozzle group 5*e*. As in the first embodiment, an example is shown where, in the case where cyan 8-bit multivalue input data 128 is input, at the upper nozzle group 5*a*, the input data 128 is corrected to 130 as an output value, and at the lower nozzle group 5*e*, the input data 128 is corrected to 120 as an output value.

Figure 12E:
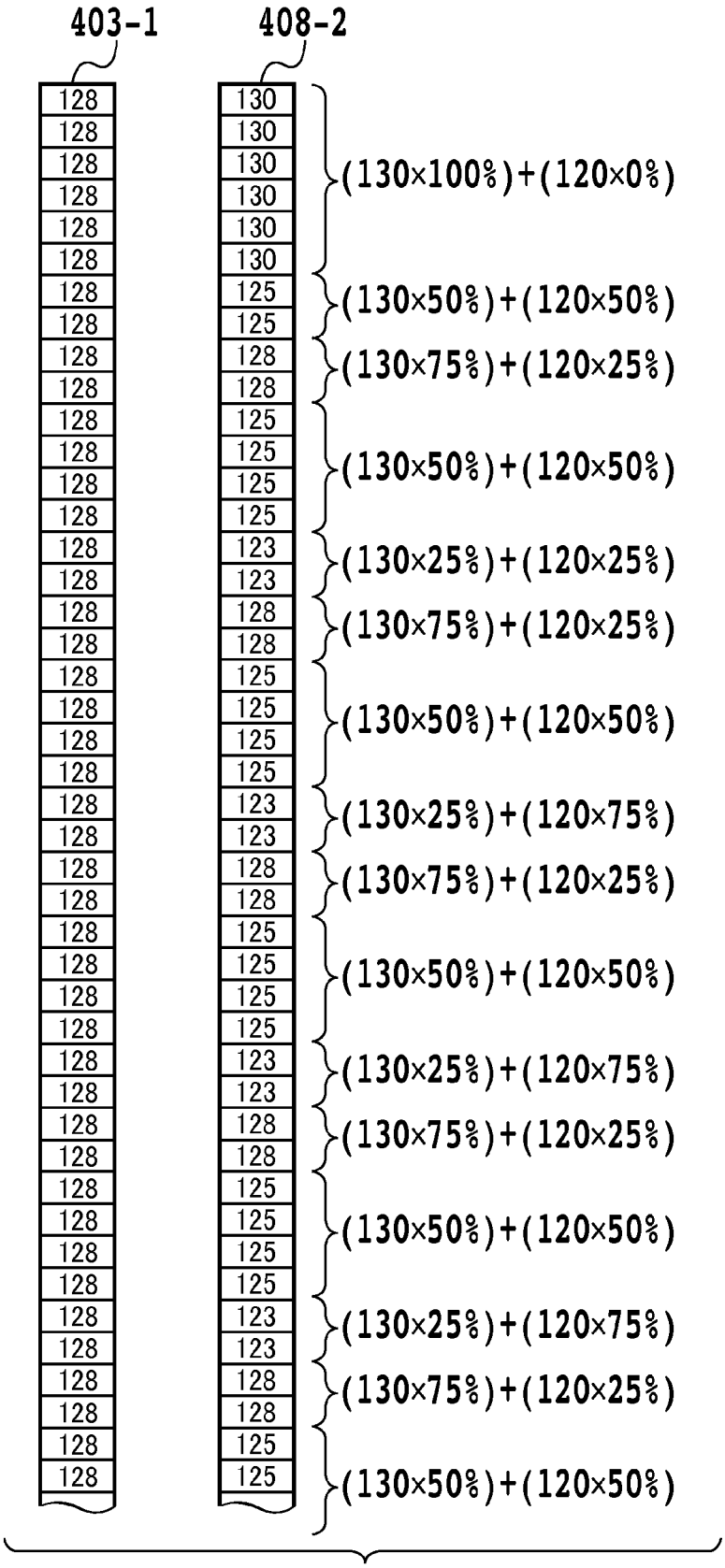

In the present embodiment, in the case (the left hand side of FIG. 12E) where cyan 8-bit multivalue input data 128 is input, the output values become as that of the right hand side of FIG. 12E. In other words, as shown in FIGS. 12D and 12E, color shift correction is carried out by allocating respective upper and lower nozzle group color shift correction output y correction values according to their respective nozzle group contribution ratios. That is, the product of the result of the upper nozzle group color shift correction and the upper nozzle group contribution ratio indicating utilization information of the upper nozzle group is taken. The product of the result of the lower nozzle group color shift correction and the lower nozzle group contribution ratio indicating utilization information of the lower nozzle group is also taken. The sum of each of these results becomes the post color shift correction value with respect to the input. In this manner, according to the present embodiment, in the case where the utilization ratios of each of the plurality of nozzle groups differ at each print area, because a density correction is carried out according to their utilization ratios (contribution ratios), the print density variation at each print area can be suppressed, and as a result the density unevenness can be reduced.

As for the above explanation, the case of 2-pass printing was explained as an example, however, the present invention is not limited to 2 passes and can be naturally applied to the case of 3-pass (or more) printing.

(Third Embodiment)

The first and second embodiments make use of a print head having an overlap portion with nozzle groups, which eject same colored ink, overlapped in the scanning direction, but the present embodiment makes use of a print head in which nozzle groups, which eject same colored ink, are aligned in a row.

Figure 13:
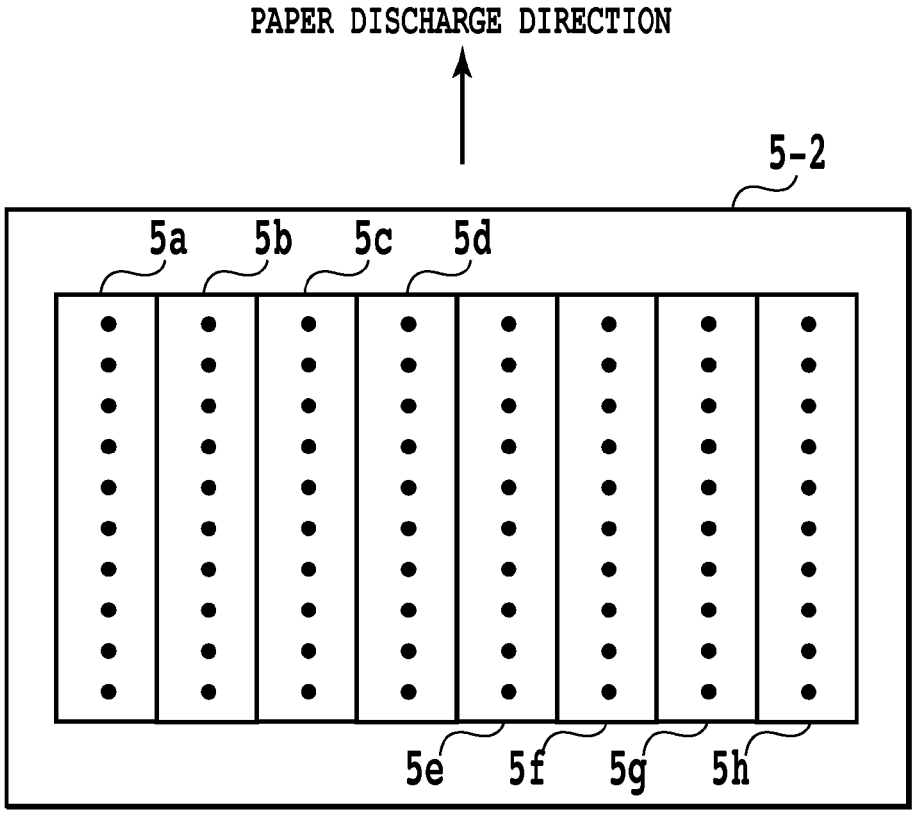
FIG. 13 is a figure that explains the arrangement of ink ejection openings of a print head of a third embodiment.

FIG. 13 is a front view of the face of the print head 5 of the present embodiment, on which ink ejection openings (nozzles) are disposed. It has a print head provided with a plurality of nozzle arrays that eject one color of ink. In the print head 5 of FIG. 13, 8 nozzle arrays 5*a* to 5*h* are disposed along the scanning direction. The nozzle arrays are each formed of 10 nozzles, and cyan (C) ink to nozzle arrays 5*a* and 5*e*, magenta (M) ink to 5*b* and 5*f*, yellow (Y) ink to 5*c* and 5*g*, and black (K) ink to 5*d* and 5*h*, are supplied.

Figure 14A:
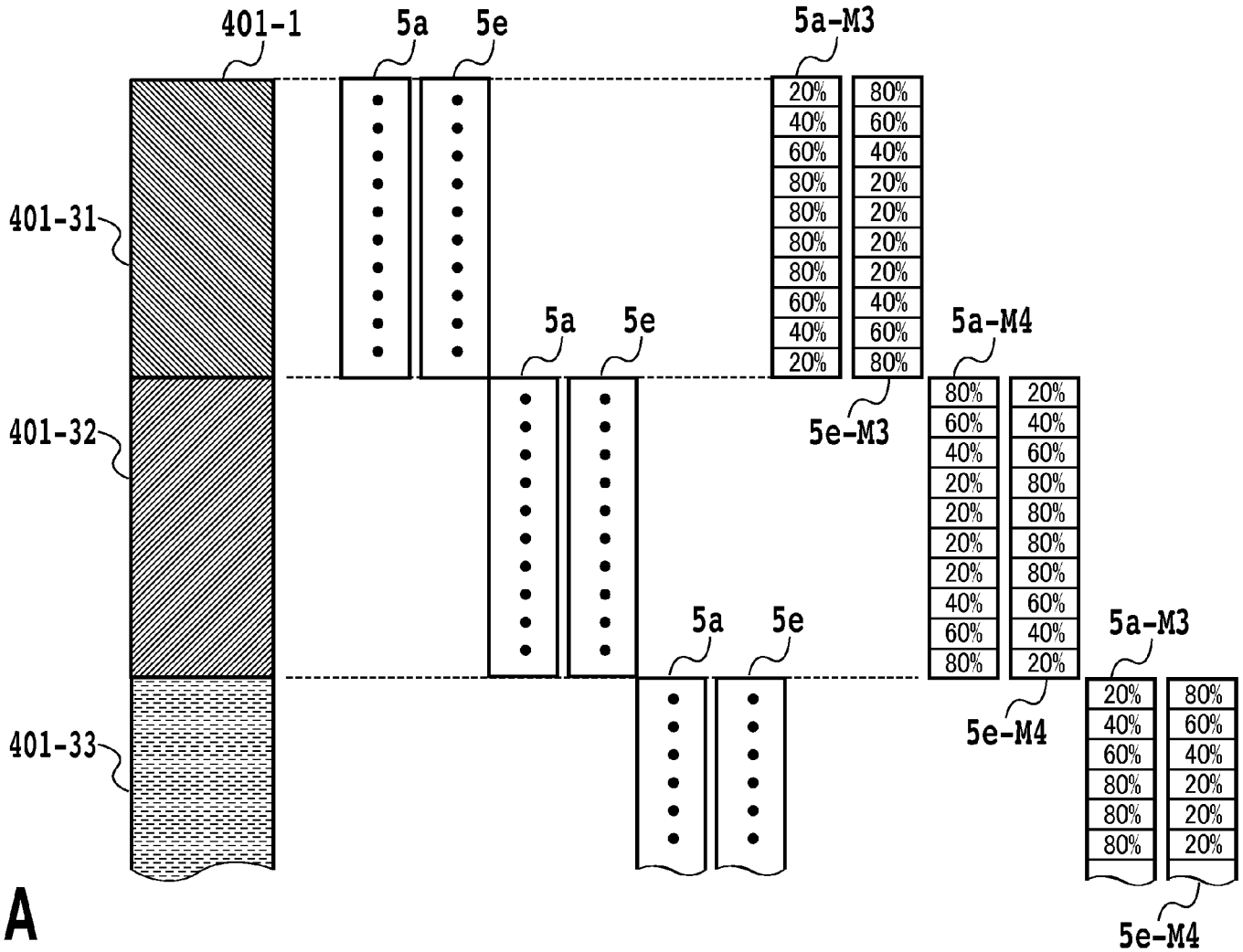

FIGS. 14A to 14D are figures that explains the color shift correction process of the present embodiment. FIG. 14A illustrates image data at respective regions and the positions of the nozzle group 5*a* and the nozzle group 5*e* at each scan. Here, at the first scan, image data is printed at the region 401-31 by the nozzle group 5*a* and the nozzle group 5*e*, and at the second scan, image data is printed and the region 401-32 by the nozzle group 5*a* and the nozzle group 5*e*. In the same manner, at the third scan, image data is printed at the region 401-33 by the nozzle group 5*a* and the nozzle group 5*e*. In this way, at each scan, image data is allocated to the nozzle group 5*a* and the nozzle group 5*e*, and printing is performed by the two nozzle groups.

FIG. 14A also shows respective mask tables 5*a*-M3 and 5*e*-Me of each of the nozzle groups 5*a* and 5*e* shown in FIG. 14A. With respect to the nozzle group 5*a*, the printing ratios at the ends of the nozzle group are 20%, the printing ratios in the central section are 80%, and the printing ratios are set up to increase as approaching the central section of the nozzle group. On the other hand, with respect to the nozzle group 5*e*, the printing ratios at the ends of the nozzle group are 80%, the printing ratios in the central section are 20%, and the printing ratios are set up to increase as approaching the ends of the nozzle group 5*e*.

Figure 14B:
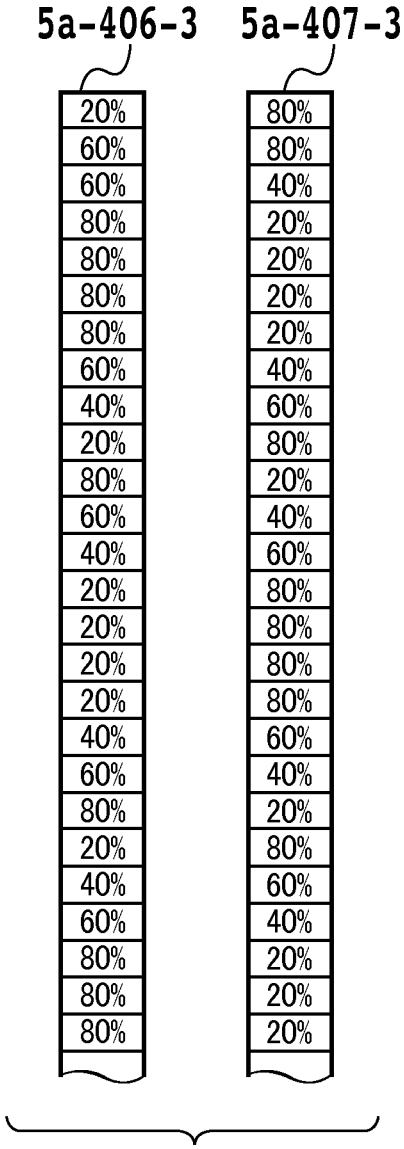

FIG. 14B shows contribution ratios with respect to the printing of the nozzle group 5*a* and the nozzle group 5*e*. Specifically, the contribution ratios 5*a*-406-3 denote contribution ratios of the nozzle group 5*a* and the contribution ratios 5*a*-406-3 denote contribution ratios of the nozzle group 5*e*.

Figure 14C:
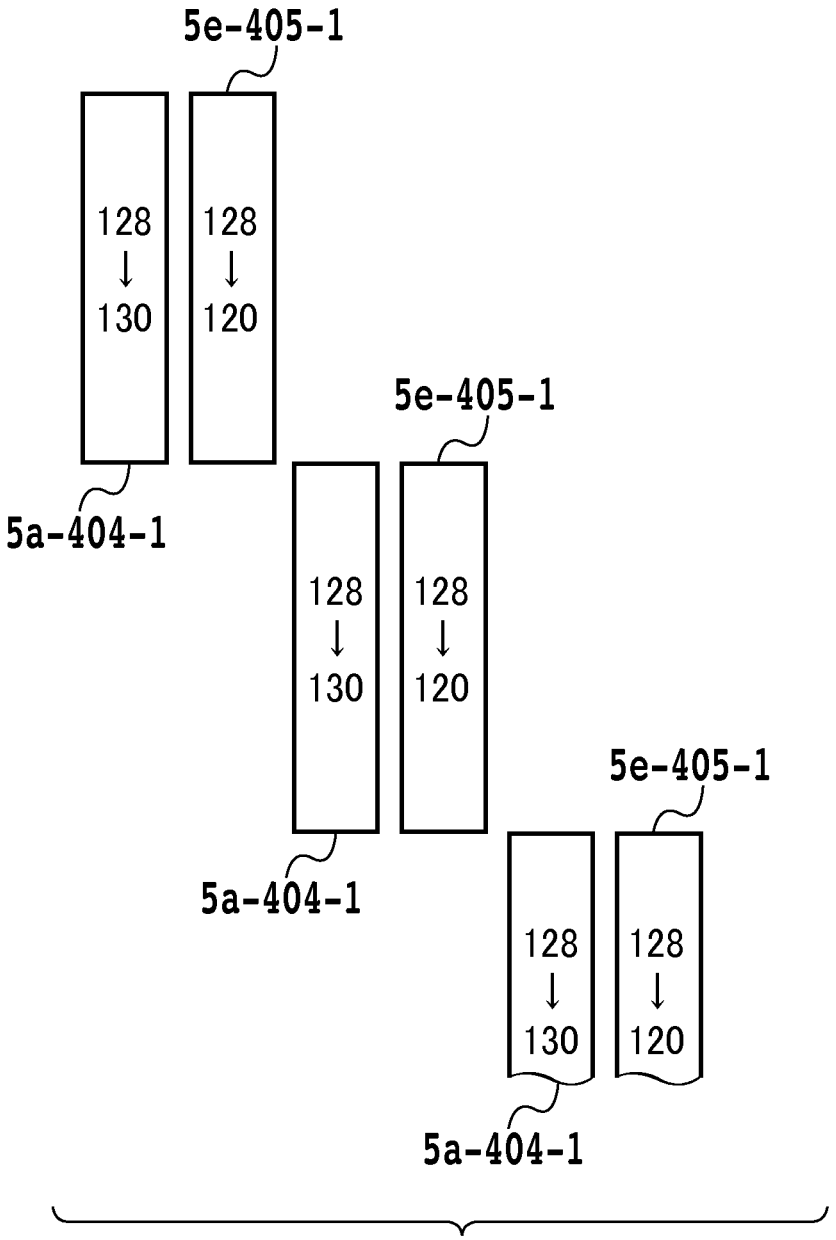

FIG. 14C, when cyan 8-bit multivalue input data is input, shows the result of the color shift correction of the nozzle group 5*a* and the result of the color shift correction of the nozzle group 5*e*. In the same manner as the first and second embodiments, an example is shown of the case where, when cyan 8-bit multivalue input data 128 is input, at the nozzle group 5*a*, the input data 128 is corrected to output data 130, and at the nozzle group 5*e*, the input data 128 is corrected to output data 120.

In the present embodiment, in the case (the left hand side of FIG. 14D) where cyan 8-bit multivalue input data 128 is input, the output values become as that of the right hand side of FIG. 14D. In other words, as shown in FIGS. 14C and 14D, color shift correction is carried out by allocating the result of respective nozzle group color shift correction according to their respective nozzle group contribution ratios. That is, the product of the result of the color shift correction for the nozzle group 5*a* and the contribution ratio of the nozzle group 5*a* is taken. The product of the result of the color shift correction for the nozzle group 5*e* and the contribution ratio of the nozzle group 5*e* is also taken. The sum of each of these results becomes the post color shift correction value with respect to the input. In this manner, according to the present embodiment, in the case where the utilization ratios of each of the plurality of nozzle groups differ at each print area, because a density correction is carried out according to their utilization ratios (contribution ratios), the print density variation at each print area can be suppressed, and as a result the density unevenness can be reduced.

While the preset invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-148828, filed Jun. 23, 2009, which is hereby incorporated by reference herein in its entirety.

What is claimed is:

1. An image processing apparatus that performs processing for printing an image on a unit area of a print medium, the printing being performed by (i) carrying out at least one relative scan of a print head provided with a plurality of nozzle arrays that apply ink of a same color to the unit area of the print medium, each of the plurality of nozzle arrays having an ejection characteristic, and (ii) applying the ink to the unit area by the plurality of nozzle arrays of the print head during the at least one relative scan, said apparatus comprising:

an acquisition unit configured to acquire multi-valued image data corresponding to the unit area;

an obtaining unit configured to obtain contribution ratios for each of the plurality of nozzle arrays in the printing of the unit area; and a correction unit configured to correct the multi-valued image data for reducing a density difference depending on the ejection characteristic of each of the plurality of nozzle arrays, based on a plurality of density correction data, which is obtained for each of the plurality of nozzle arrays, and the contribution ratios.

2. The image processing apparatus according to claim 1, wherein the plurality of the density correction data are acquired by carrying out color measurement of patches printed by using each of the plurality of nozzle arrays.

3. The image processing apparatus according to claim 1, wherein the density correction data is information on an amount of ink applied by the nozzle array.

4. The image processing apparatus according to claim 1, wherein the correction unit corrects the multi-valued image data to obtain corrected multi-valued data, which is expressed as the sum of products of a value corrected by using the density correction data and the contribution ratio, with respect to the plurality of nozzle arrays.

5. The image processing apparatus according to claim 1, further comprising:

a generation unit configured to generate binary data based on the multi-valued data corrected by the correction unit; and an allocation unit configured to allocate the binary data to each of the plurality of nozzle arrays at the corresponding contribution ratio.

6. The image processing apparatus according to claim 1, wherein each of the plurality of density correction data is in a form of a one dimensional unit lookup-table.

7. The image processing apparatus according to claim 1, wherein said correction unit corrects the multi-valued image data for reducing the density difference caused by ejection amount variation between the plurality of nozzle arrays.

8. The image processing apparatus according to claim 1, wherein the plurality of nozzle arrays are arranged shifted from each other in an array direction of nozzles and have an overlap portion and a non-overlap portion.

9. The image processing apparatus according to claim 8, wherein at the overlap portion, the contribution ratios for each of the plurality of nozzle arrays decrease gradually as approaching an end of the nozzle array.

10. An image processing method of performing processing for printing an image on a unit area of a print medium, the printing being performed by (i) carrying out at least one relative scan of a print head provided with a plurality of nozzle arrays that apply ink of a same color to the unit area of the print medium, each of the plurality of nozzle arrays having an ejection characteristic, and (ii) applying the ink to the unit area by the plurality of nozzle arrays of the print head during the at least one relative scan, said method comprising:

an acquisition step of acquiring multi-valued image data corresponding to the unit area;

an obtaining step of obtaining contribution ratios for each of the plurality of nozzle arrays in the printing of the unit area; and a correction step of correcting the multi-valued image data for reducing a density difference depending on the ejection characteristic of each of the plurality of nozzle arrays, based on a plurality of density correction data, which is obtained for each of the plurality of nozzle arrays, and the contribution ratios.

11. An image printing apparatus that prints an image on a unit area of a print medium, comprising:

a print unit comprising a plurality of nozzle arrays configured to apply ink of a same color to the unit area of the print medium, each of the plurality of nozzle arrays having an ejection characteristic, wherein the print unit is configured to perform at least one relative scan during which the ink is applied to the unit area of the print medium to form the image;

an acquisition unit configured to acquire multi-valued image data corresponding to the unit area;

an obtaining unit configured to obtain contribution ratios for each of the plurality of nozzle arrays in the printing of the unit area; and a correction unit configured to correct the multi-valued image data for reducing a density difference depending on the ejection characteristic of each of the plurality of nozzle arrays, based on a plurality of density correction data, which is obtained for each of the plurality of nozzle arrays, and the contribution ratios, wherein the print unit forms the image on the unit area of the print medium based on the corrected multi-valued image data corrected by the correction unit.

* * * * *